US006022090A

United States Patent [19]

Coudray et al.

[11] Patent Number: 6,022,090

[45] **Date of Patent: *Feb. 8, 2000**

[54] CHECKING OF THE OPERATION OF THE TRANSFER OF INK IN AN IMAGE TRANSFER DEVICE

[75] Inventors: Pascal Coudray, La Chapelle des Fougeretz; Alexandre Dodge, Pace; Noboru Nakatani, Rennes; Marie-Hélène Froger, Chateaugiron; Christophe Truffaut, Rennes, all of France

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,134

[22] Filed: Dec. 26, 1996

[30] Foreign Application Priority Data

| | | | |
|---|---|---|---|
| Jan. 12, 1996 | [FR] | France | 96 00339 |
| Feb. 27, 1996 | [FR] | France | 96 02406 |

[51] Int. Cl.[7] ..... B41J 2/195

[52] U.S. Cl. ..... 347/7

[58] Field of Search ..... 347/7, 14, 19

[56] References Cited

U.S. PATENT DOCUMENTS

| | | | |
|---|---|---|---|
| 4,853,718 | 8/1989 | Elhatem | 347/7 |
| 5,162,817 | 11/1992 | Tajika | 347/7 |
| 5,617,121 | 4/1997 | Tachihara | 347/7 |
| 5,635,961 | 6/1997 | Sato | 347/7 |
| 5,682,184 | 10/1997 | Stephany | 347/7 |

FOREIGN PATENT DOCUMENTS

| | | | |
|---|---|---|---|
| 0 370 765 | 5/1990 | European Pat. Off. | 347/7 |
| 0 444 861 | 9/1991 | European Pat. Off. | 347/7 |
| 0 626 261 | 11/1994 | European Pat. Off. | 347/7 |
| 0 661 162 | 7/1995 | European Pat. Off. | 347/7 |
| 2-208052 | 8/1990 | Japan | 347/7 |
| 6-126951 | 5/1994 | Japan | 347/7 |
| 6-297726 | 10/1994 | Japan | 347/7 |

*Primary Examiner*—Christopher A. Bennett
*Attorney, Agent, or Firm*—Fitzpatrick, Cella, Harper & Scinto

[57] ABSTRACT

The invention concerns a device for checking the operation of a unit comprising an ink reservoir (112) connected to at least an ink transfer means (113, 204), for an image transfer device (10), characterized in that it includes a means (205, 31, 230) for transmitting energy to ink contained in the ink transfer means, and a means (115, 100) for analyzing the energy transmitted to the ink, with a view to checking the operation of said unit.

52 Claims, 13 Drawing Sheets

CHECKING OF THE OPERATION OF THE TRANSFER OF INK IN AN IMAGE TRANSFER DEVICE

Figure 1:
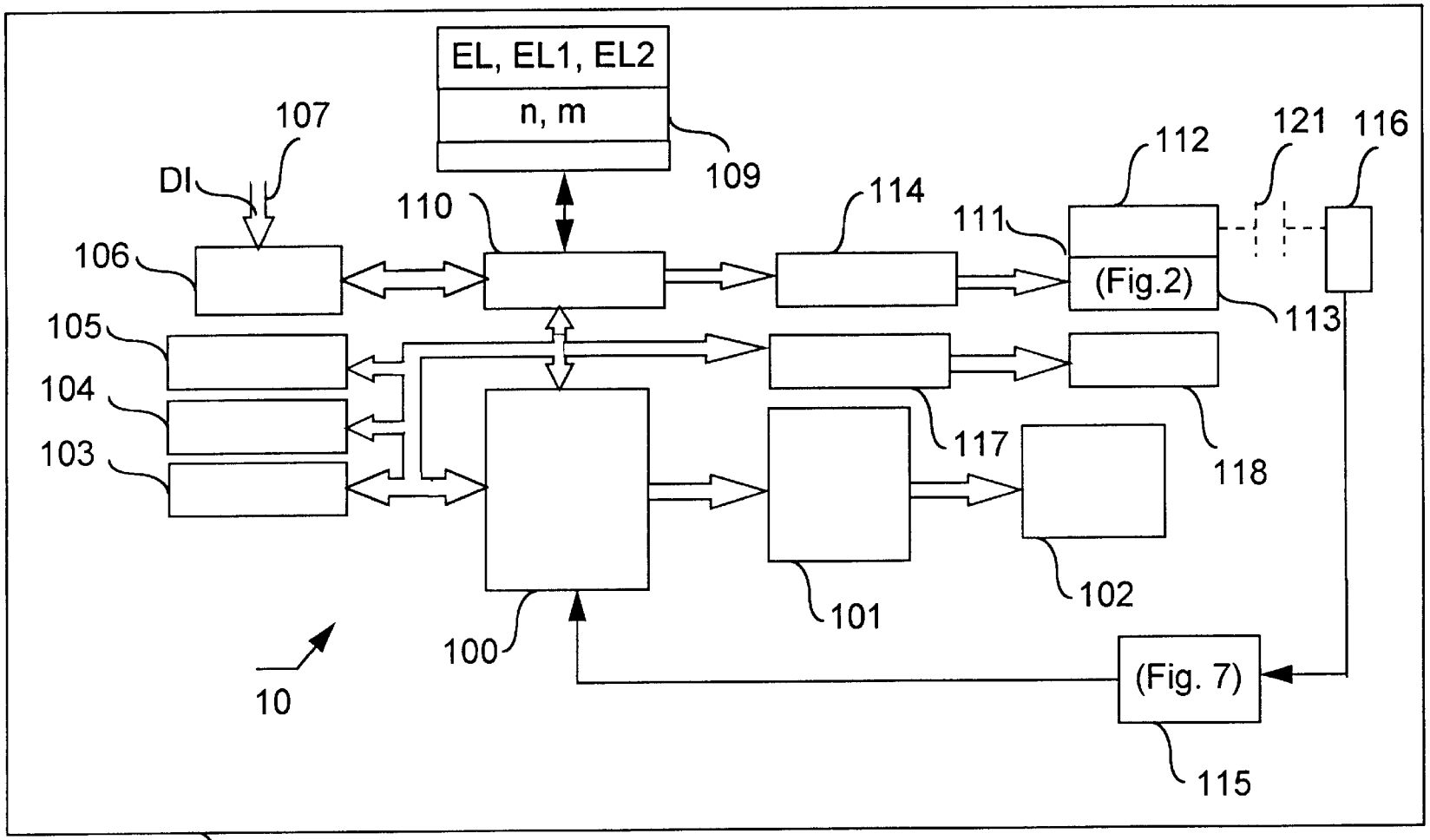

The present invention concerns, in general terms, an image transfer device having an ink reservoir associated with at least an ink transfer means.

The ink reservoir and the ink transfer means can be a single assembly, or alternatively two separate structures. However, in any case, the ink reservoir and the ink transfer means are considered by a user as a unit, the operation of which is to be checked. The invention relates more particularly to a method and device for checking the operation of a unit comprising the ink reservoir and the ink transfer means of an image transfer device.

On the one hand, for image transfer devices which use ink-jet technology, such as ink-jet printers, numerous devices and methods have been designed to detect the absence of ink.

A first known type of detection uses the electrical characteristics of ink by measuring the resistance thereof between two electrodes.

The document EP-A-0 370 765 describes a detection device comprising two electrodes positioned in the channel connecting an ink ejection head to the ink reservoir and a means of detecting the electrical resistance between the two electrodes. The first electrode is situated close to the ejection head while the second is distant from it. A potential difference is applied between these two electrodes. The resistance of the ink is measured and the presence or absence of ink is deduced from the resistance value measured.

The two electrodes must necessarily be spaced a predetermined distance apart, which complicates the production of the ink cartridge or ejection head and increases the cost of production.

Furthermore, the electrodes placed in the cartridge are subjected to a to-and-fro movement of the carriage moving the cartridge along the sheet. The two-and-fro movement disrupts the detection of the level of ink and therefore renders continuous measurement, that is to say measurement during the printing of the document, difficult.

Additional connections needed to detect ink must be provided in the interconnection system.

In the case of a printer having several ink reservoirs, such as colour printers, electrodes must be fitted to each of the reservoirs, making detection devices very expensive.

Additionally, these devices do not detect the presence of air bubbles in the ink, air bubbles preventing the full reproduction of the document. It has been observed that the problem of air bubbles is particularly significant for image transfer devices using ink cartridges whose ink reservoir and ejection head are separate. Furthermore, when the ink reservoir in these devices is changed, the ejection head and the channel connecting it to the reservoir are totally purged to evacuate these air bubbles.

A large quantity of ink is thus consumed with the sole aim of evacuating these bubbles.

A second known type of detection consists of reproducing a motif on the document to be printed and detecting this motif by means of an optical sensor. This is described in the document JP-A-6 126 951.

The second type of detection does not increase the complexity of the ink cartridge, but the use of an optical sensor increases the price of the printing device. It is, moreover, necessary to add a printed area to the document, for example a black square at the foot of each page printed, which impairs the quality of the document reproduced. This type of ink detection can therefore be used only in specific applications.

Optical detection is, moreover, sensitive to the printing medium used, and to the ink. Black ink on white paper is the easiest to detect. Today, however, numerous printing media exist, for example coloured paper, recycled paper or transparent sheets. Such media limit the use of such a method.

What is more, if air bubbles are present in the ink as the page is printed, but not when the black square used for detection is printed, they will not be detected.

Finally, this type of detector is difficult to use for colour printing. This is because a detector capable of recognising each colour used is required. A motif of each colour must be printed on the printing medium.

On the other hand, in an image transfer device using ink jet technology, such as an ink jet printer, a printing head has a plurality of ink transfer means in the form of ejection channels, generally identical and parallel, which enable several drops of ink to be ejected simultaneously and thus increase the printing speed of the image transfer device.

In order to obtain good reproduction quality for documents, the resolution, that is to say the number of dots printed per unit surface area, must be high. This results in an increase in the number of ink ejection channels per unit surface area and a reduction in their diameter.

The size and density of the ink ejection channels make the ink ejection means complicated to use and malfunctions can arise therein. These malfunctions arise notably from the fact that one or more channels do not eject any ink, despite an ink ejection command transmitted to them, modifying the printing in an undesirable fashion.

The causes of these malfunctions are, for example, an impurity blocking the ejection channel, or some ink which has dried in the channel, or an absence of ink in the channel.

It is possible to provide cleaning and purging phases for the ink ejection means in order to avoid some of these malfunctions. However, these phases entail a significant consumption of ink.

The present invention aims to overcome the drawbacks of the prior art, by providing a device and method for checking the operation of a unit comprising an ink reservoir and an ink transfer means which detect any type of faulty functioning of this unit, while being simple and economical to use.

In the course of their research, the inventors determined that, by transmitting electrical energy to the ink contained in an ejection channel and analysing the effect produced, it is possible to derive information on the operation of the unit comprising the ink reservoir and the channel in question.

In this context, the invention provides a device for checking the operation of a unit comprising an ink reservoir connected to at least an ink transfer means, for an image transfer device, characterised in that it includes:

- a means for transmitting energy to ink contained in the ink transfer means, and
- a means for analysing the energy transmitted to the ink, with a view to checking the operation of said unit.

The invention provides a device for checking the operation of a unit comprising an ink reservoir connected to at least an ink transfer means for an image transfer device, characterised in that includes:

- a means for generating electrical signals,
- a means for transmitting energy from the electrical signals to ink contained in the ink transfer means,
- a means for detecting the energy transmitted to the ink, and
- a means for producing signals representing the operation of said unit according to the energy detected.

In relation to this, the invention proposes a method of checking the operation of a unit comprising an ink reservoir connected to at least an ink transfer means, for an image transfer device, characterised in that it includes the steps of:

transmitting energy to ink contained in the ink transfer means, and analysing the energy transmitted to the ink, with a view to checking the operation of said unit.

The invention provides a method of checking the operation of a unit comprising an ink reservoir connected to at least an ink transfer means, for an image transfer device, characterised in that it includes the steps of:

generating electrical signals, to transmit energy from the electrical signals to ink contained in the ink transfer means, detecting the energy transmitted to the ink, and producing signals representing the operation of the ink transfer means according to the energy detected.

The device and method according to the invention have not only the advantage of resolving the technical problem described above, but also the advantage of requiring few modifications to the image transfer device, and therefore being inexpensive and adapting to a large number of existing image transfer devices, such as ink jet printers or laser printers, for example.

The checking device according to the invention operates whatever the type of ink (colour, composition, etc.), with the sole condition that it must be conductive. "Ink" is here used to mean any product in liquid, solid, gaseous or powder form designed to modify an optical factor of the printing medium.

Advantageously, the means for generating electrical signals is a means for generating control signals for the ink transfer means. The means for generating control signals is thus used, according to its conventional function, to cause the ink transfer means to operate, but also, according to the invention, to generate signals serving to check the operation of the unit comprising the ink reservoir and the ink transfer means. It is not, therefore, necessary to provide an additional means for generating electrical signals which is specific to the invention.

A first embodiment of the invention is directed to the detection of presence or absence of ink in the ink reservoir. The means for detecting is a means for sensing electromagnetic radiation.

According to a first preferred characteristic of the first embodiment, the means for sensing electromagnetic radiation is a metal component forming an antenna. Even more preferably, the means for sensing electromagnetic radiation is a metal ribbon.

Conventionally, at least the ink transfer device, and more generally the ink reservoir and ink transfer means, are able to move on a movement path opposite a printing medium. The means for sensing electromagnetic radiation is then advantageously disposed on the said movement path, and preferably extends over the whole length of the movement path.

Thus the detection of the presence or absence of ink takes place in the course of the operation of the image transfer device, and preferably during the whole of this operation. The absence of ink is able to be detected in real time.

As a variant, the means for sensing electromagnetic radiation is disposed on the ink reservoir. This variant also permits immediate detection of the absence of ink.

According to another characteristic of the invention, the means for converting the electromagnetic radiation sensed comprises:

a comparator for comparing a signal supplied by the means of sensing with a reference signal and supplying the signal representing the presence or absence of ink in the reservoir, according to the result of the comparison. Thus the presence or absence of ink in the reservoir are determined with respect to a threshold which is preferably adjustable.

The detection device according to the first embodiment of the invention detects both a "definitive" absence of ink in the reservoir when the latter is empty, and a "momentary" absence due to an ink bubble, for example.

Furthermore, the document to be printed is not modified by the operation of the detection device, which thus functions without the user being aware of it, for as long as there is ink in the reservoir.

According to preferred characteristics of the first embodiment of the invention, the ink detection method is characterised in that it comprises the step of detecting the energy transmitted to the ink by the electrical signals simultaneously with the ink transfer step, and in that it comprises, for a line to be printed, the steps of:

detecting the energy transmitted to the ink by the said electrical signals simultaneously with the printing of the line, and interrupting printing if the energy detected is below a threshold and continuing printing if it is not.

Advantageously, the ink detection method according to the first embodiment of the invention can be easily adapted to an image transfer device of the ink jet type comprising a number of ink reservoirs. The ink detection method is then characterised in that it comprises the steps of:

positioning the transfer means opposite an area situated outside the printing medium, controlling the ejection by the transfer means of a predetermined number of ink drops, detecting the energy transmitted to the ink by the said electrical signals simultaneously with the ejection of ink, repeating the controlling and detecting steps for each of the ink reservoirs, and activating an alarm if the energy detected is below a threshold.

Preferably, the ink detection method is then implemented between the printing of two pages of a document.

According to another characteristic, the ink detection method comprises the steps of:

positioning the transfer means opposite an area situated outside the printing medium, controlling the ejection by the transfer means of a predetermined number of ink drops, detecting the energy transmitted to the ink by the said electrical signals simultaneously with the ejection of ink, and repeating the steps of controlling and detecting so long as the energy detected is below a threshold.

Preferably, the area situated outside the printing medium is situated level with a pump for purging the ejection means. The method is then able to be used to optimise the phase of purging an image transfer device of the ink jet type whose transfer means, or ejection head, is not integral with the ink reservoir. When the reservoir is empty, it is only necessary to replace the latter with a reservoir full of ink, but it is then necessary to pump some ink to purge the air contained in the channel connecting to the head. The method according to the invention limits the quantity of ink pumped after a change of ink reservoir.

A second embodiment of the invention is directed to the checking of the operation of the ink transfer means.

According to a first preferred characteristic of the second embodiment of the invention, the means for transmitting includes a first capacitor positioned between the means for generating and the ink transfer means. Even more preferably, the first capacitor is positioned between a means of triggering the transfer of ink and the ink transfer means. The energy is then transmitted by capacitive effect.

In the case of a plurality of ink transfer means, the device includes a means for transmitting respectively for each transfer means of the said plurality, and the means for transmitting for one of the transfer means transmits energy only to the said one of the transfer means. It is then possible to check the operation of each of the transfer means, independently of the other transfer means, and thus identify any defective transfer means amongst all the transfer means.

Advantageously, the first capacitor has a pole formed by the ink contained in the ink transfer means. Thus the presence of a metal electrode in contact with the ink contained in the transfer means is avoided, which electrode would complicate manufacture and increase the cost thereof.

When an insulant is situated between the trigger means and the ink transfer means, the insulant comprises, according to one characteristic of the invention, an area of predetermined thickness adapted to form a dielectric of the first capacitor between a pole situated in the trigger means and the pole formed by the ink contained in the ink transfer means. The area of predetermined thickness is positioned so as to transmit energy only to a single ink transfer means.

When the characteristics of the ink are modified, for example when it has dried, or it is present in a smaller quantity in the ink transfer means, thereby affecting the operation of the ink transfer means, the electrical characteristics of the first capacitor are also modified, which has an effect upon the transfer of energy. As a consequence, the changes to the ink in the transfer means are detected by the invention.

According to another characteristic of the second embodiment of the invention, the means for detecting includes a second capacitor. Detection is thus performed by capacitive effect.

Advantageously, the second capacitor has a first pole formed by a conductive plate and a second pole formed by the ink; the conductive plate is preferably positioned on a reservoir, formed at least partially from an insulating material, containing ink and connected to the ink transfer means. The presence of an electrode in contact with ink is thus avoided, which simplifies the manufacture of the reservoir.

The method according to the second embodiment of the invention is applicable to a plurality of ink transfer means. In this case, it includes the steps of:

generating electrical signals to transmit energy from the electrical signals to ink contained in a single ink transfer means in the said plurality, detecting the energy transmitted to the ink, and producing signals representing the operation of the said single ink transfer means according to the energy detected.

These steps can be performed for each of the ink transfer means.

According to characteristics of the second embodiment of the invention, the detection step includes the step of deriving a first signal representing the said energy detected, and the production step includes the step of converting the first signal to a second signal representing the operation of the ink transfer means.

According to another aspect, the invention proposes a printing head for an image transfer device, including a plurality of ink transfer channels, characterised in that it includes for each channel of the said plurality of ink transfer channels a means of transmitting energy to ink contained in the said channel.

According to yet another aspect, the invention concerns an ink reservoir for an image transfer device, characterised in that it includes a conductive plate positioned on an external face of the reservoir opposite the ink contained in the reservoir.

The printing head and reservoir are designed to be used according to the invention, and afford similar advantages to those of the above device and method.

Figure 3:
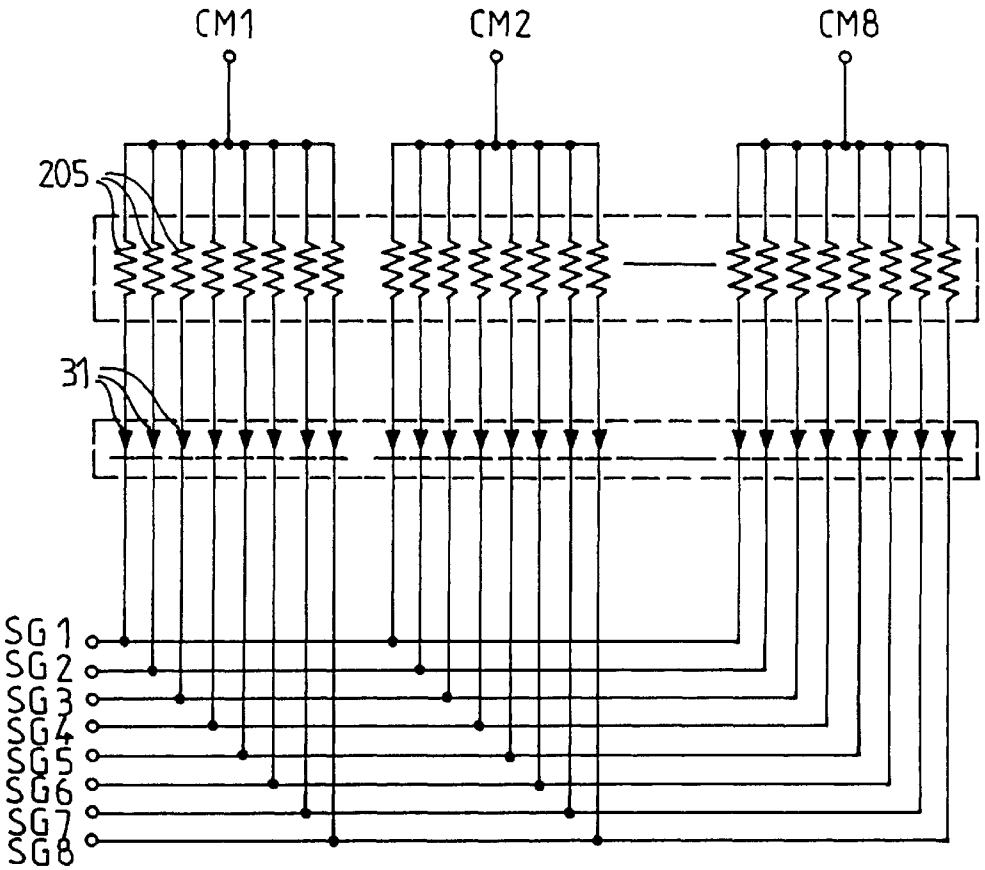
Figure 2:
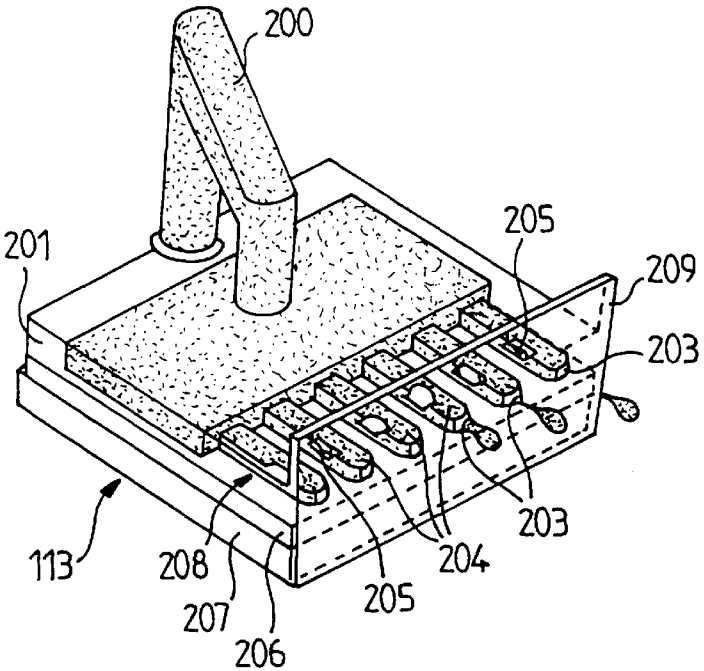
Figure 4:
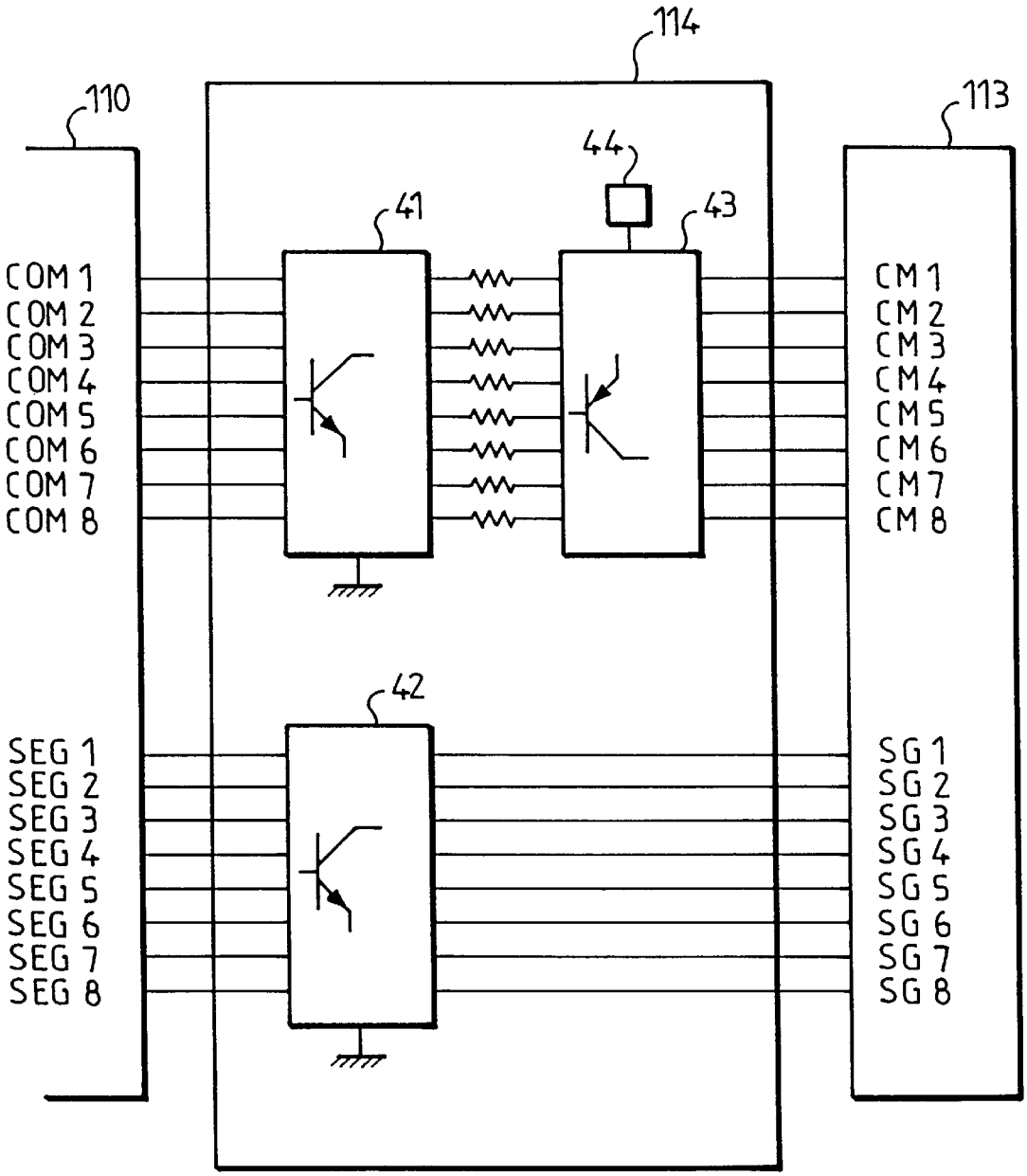
Figure 5:
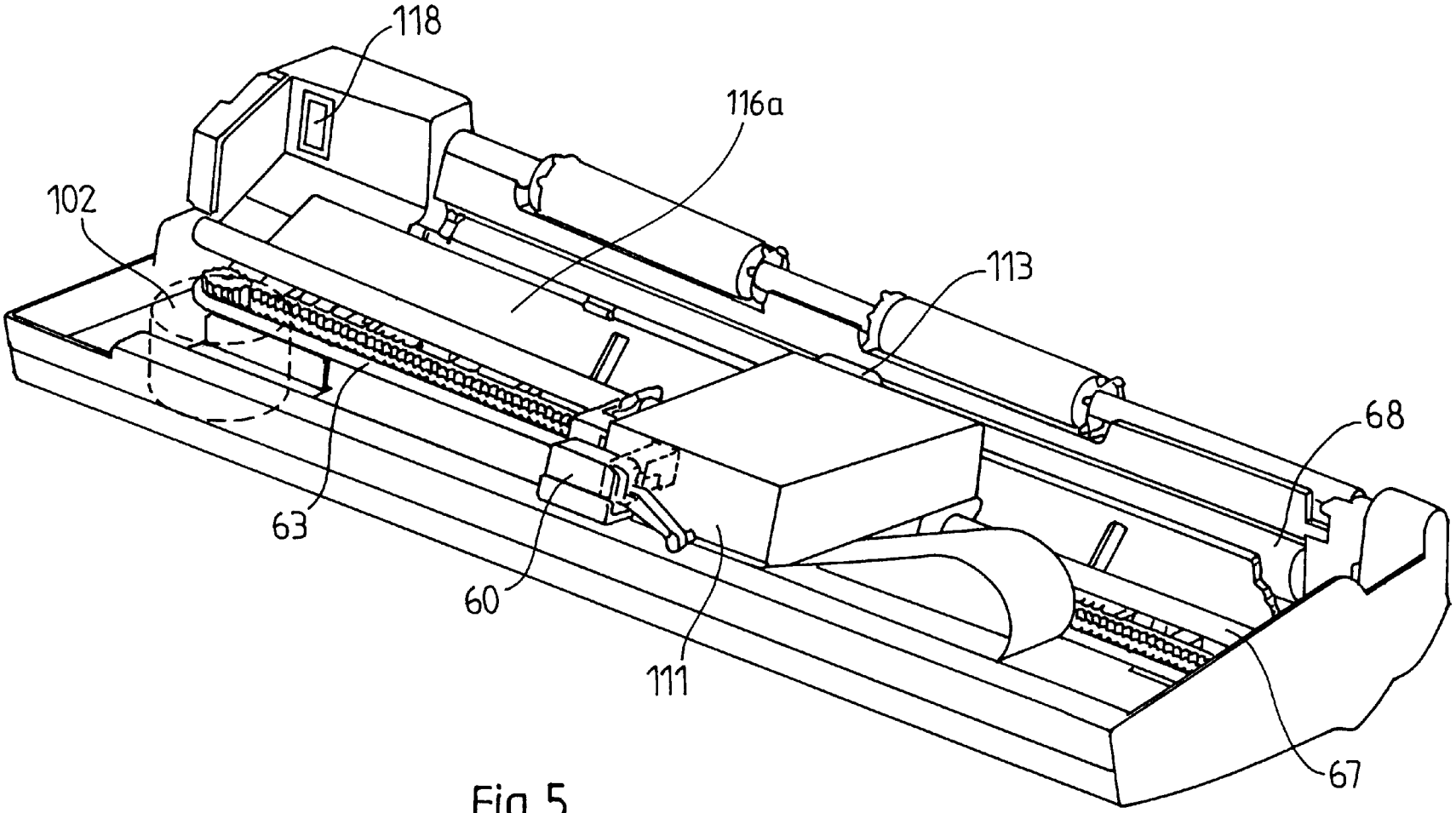
Figure 6:
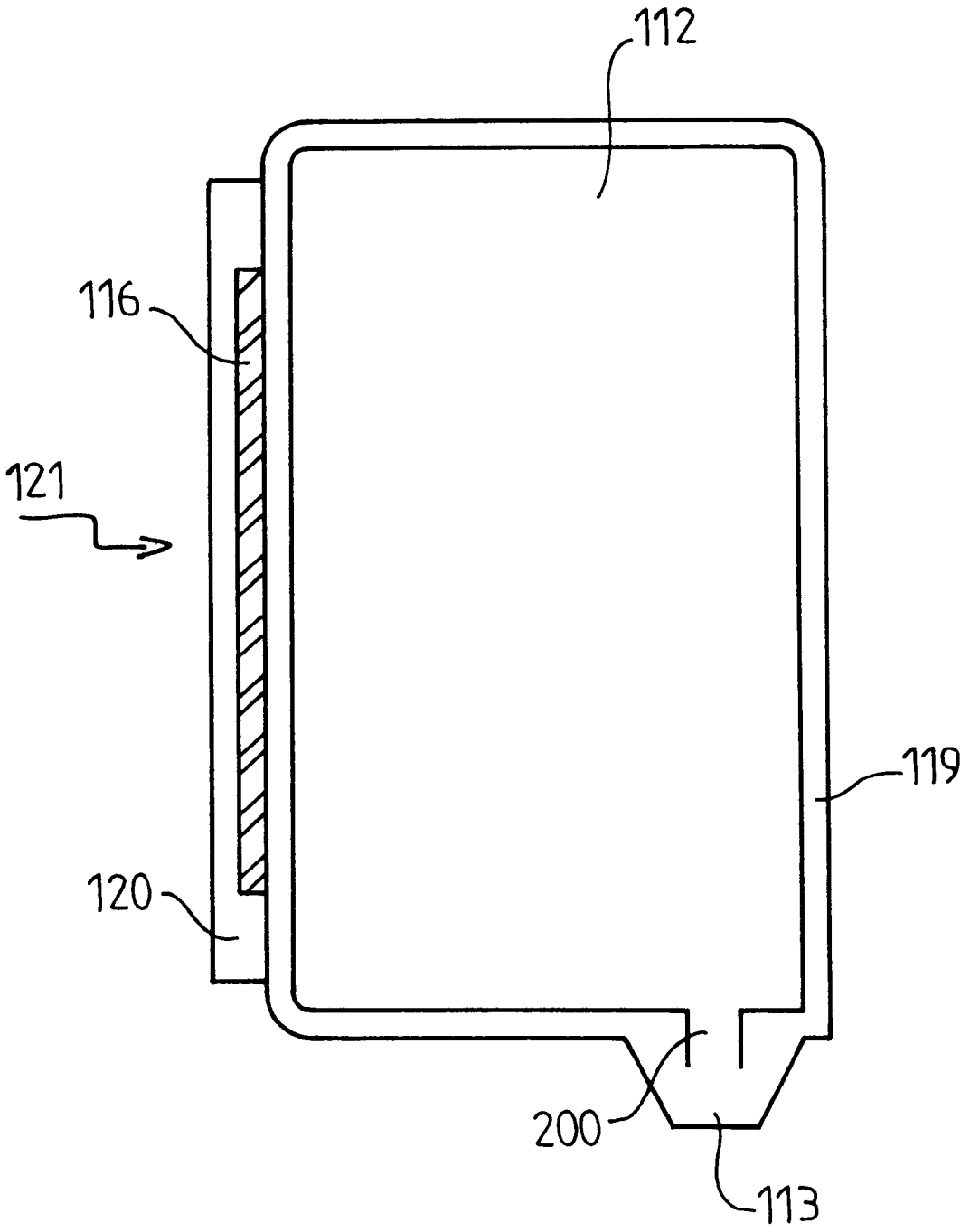
Figure 7:
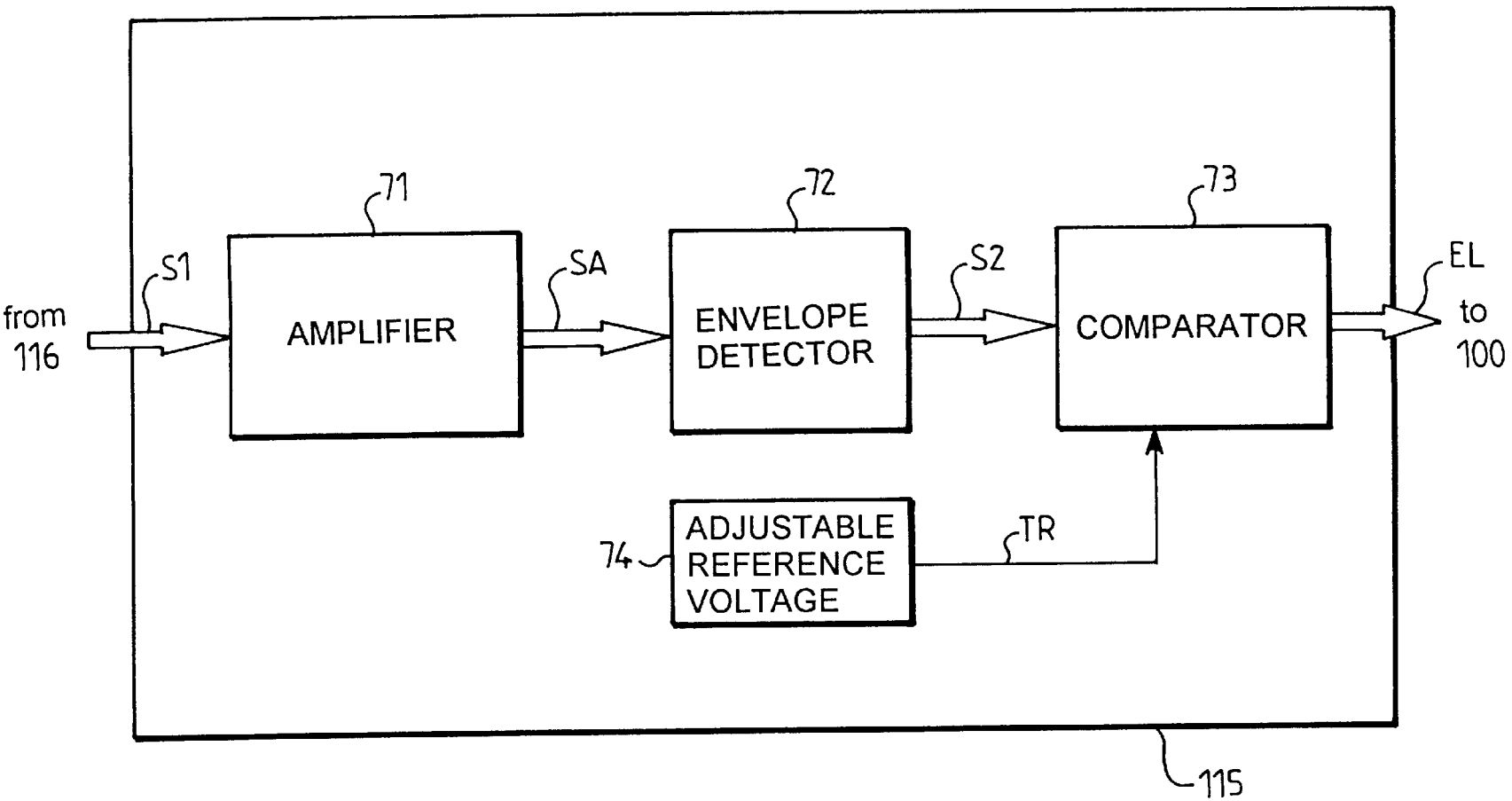
Figure 8:
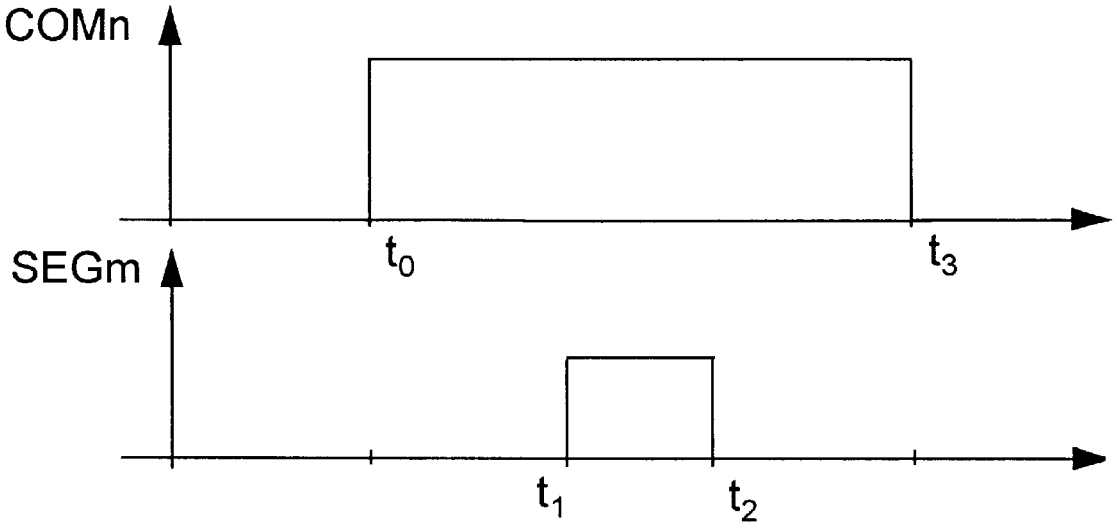
Figure 9:
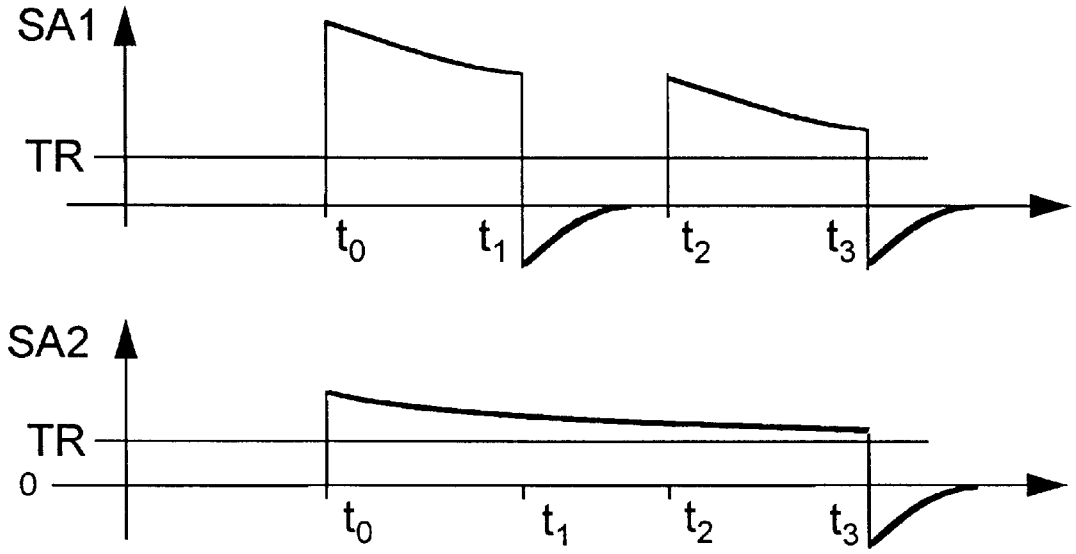
Figure 10:
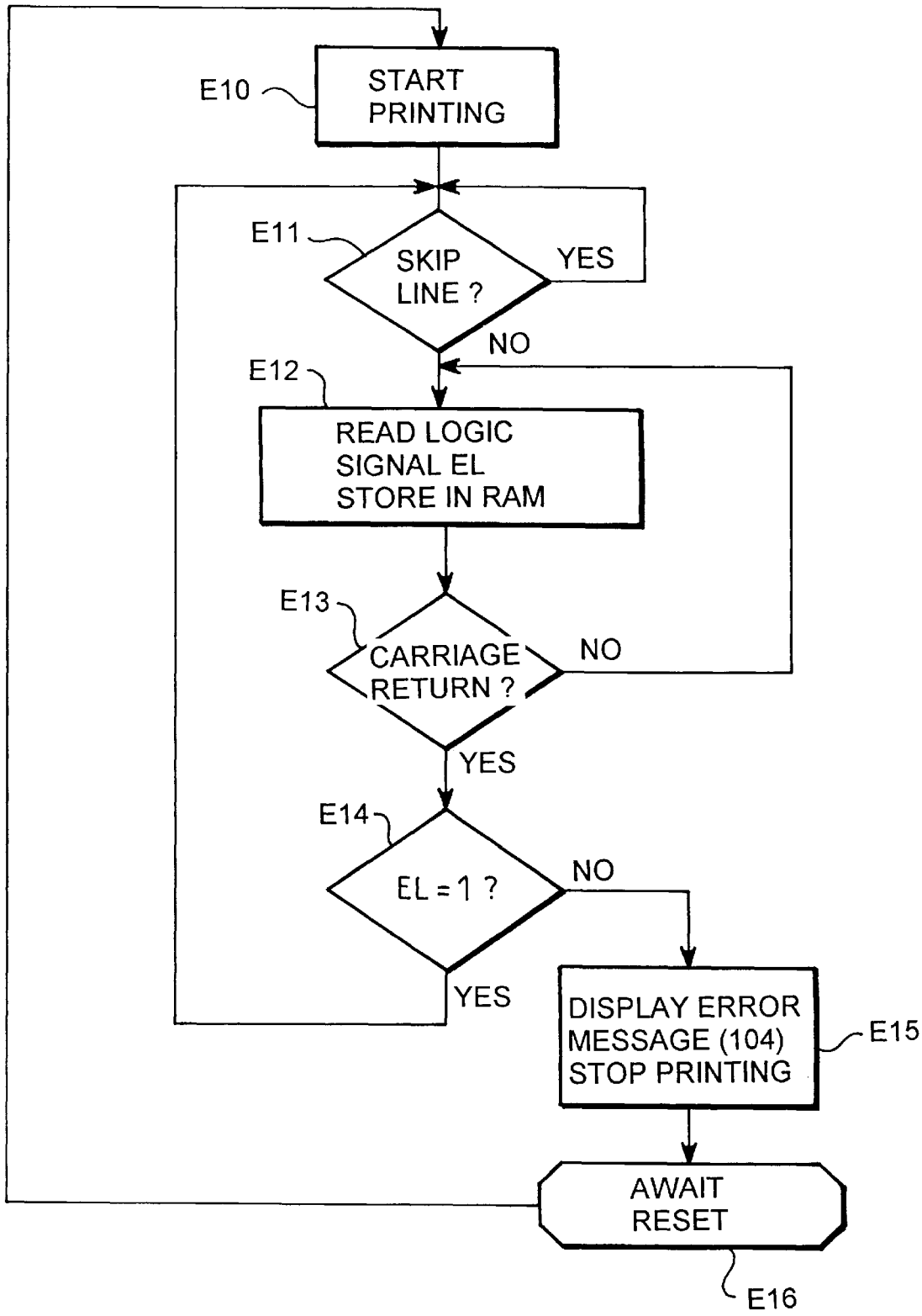
Figure 11:
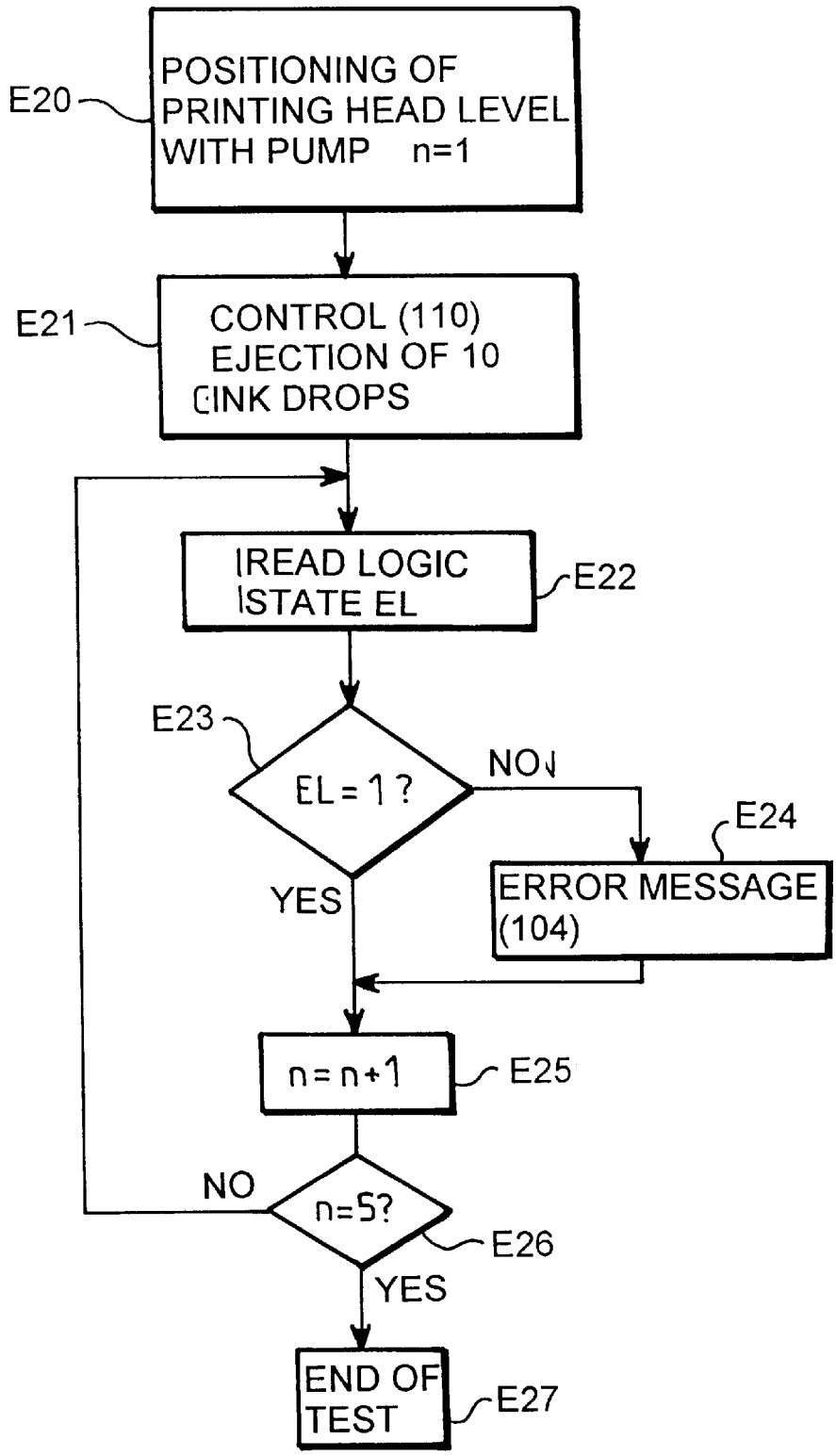
Figure 12:
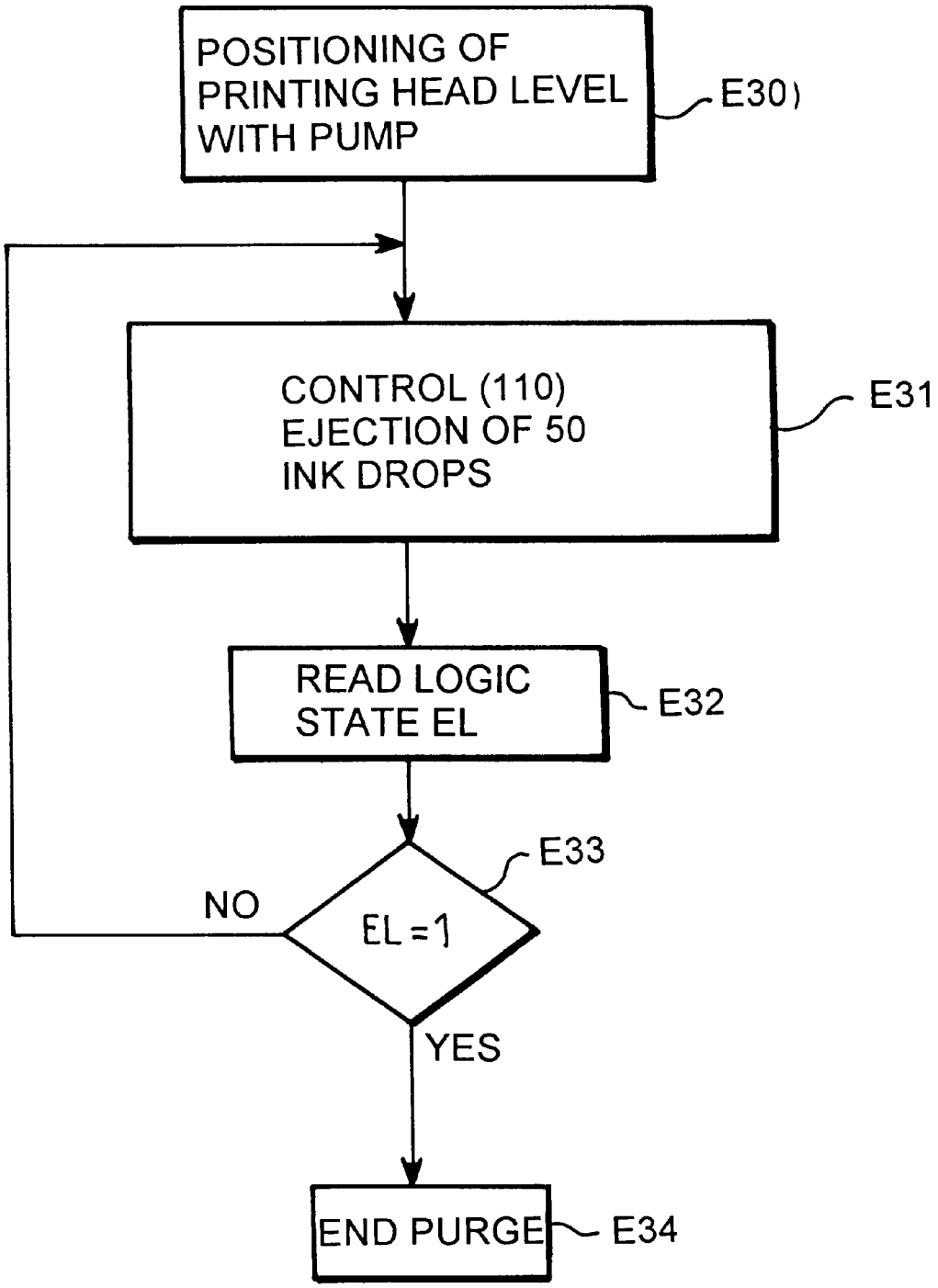
Figure 13:
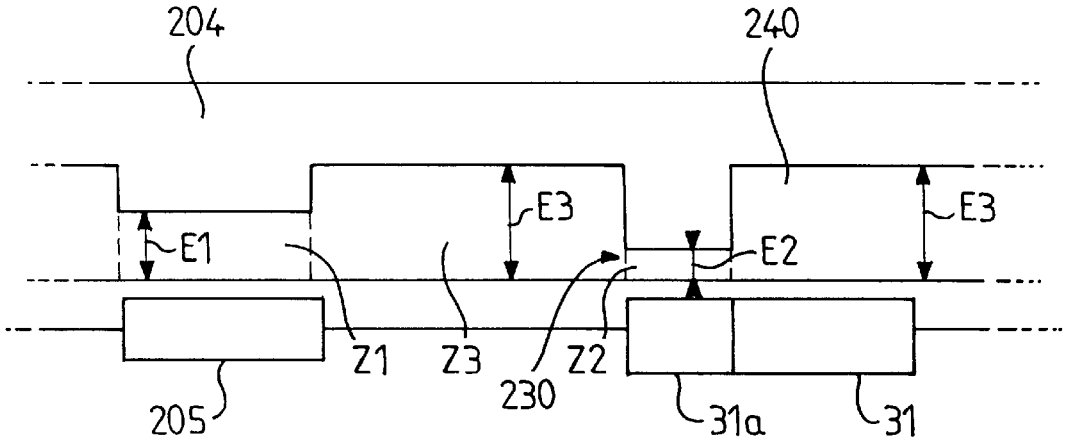
Figure 14:
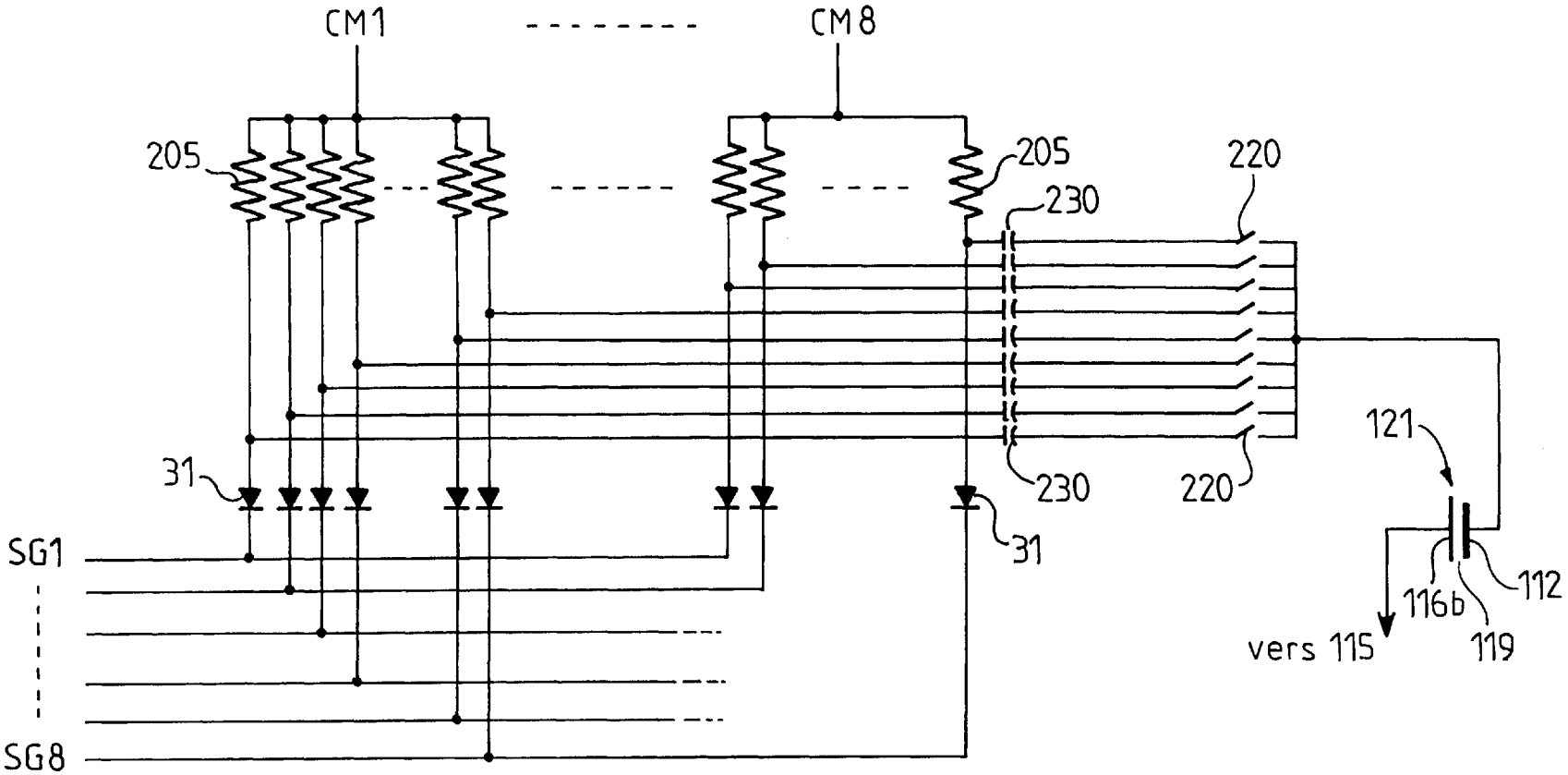
Figure 15:
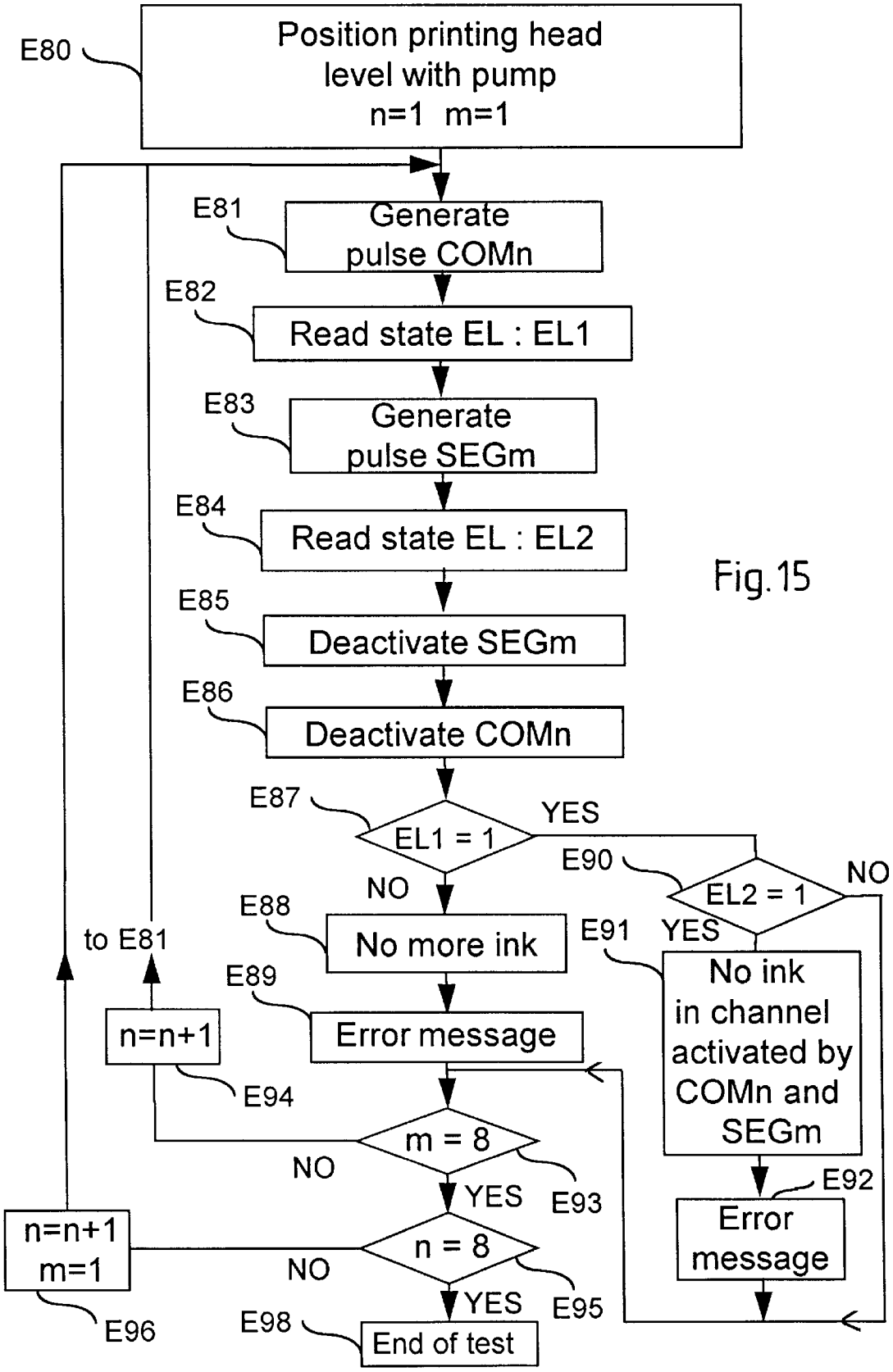

The characteristics and advantages of the present invention will emerge more clearly from a reading of several embodiments illustrated by the accompanying drawings, in which:

FIG. 1 is a block diagram of an embodiment of an image transfer device according to a first and a second embodiments of the invention, FIG. 2 is a diagrammatic perspective view of a printing head of the ink drop ejection type, used in the device in FIG. 1, FIG. 3 is a diagram of the electrical part of ink ejection means, situated in the printing head of FIG. 2, FIG. 4 is a diagram of a part of the control means for the ink ejection means, FIG. 5 is a perspective view of part of the image transfer device according to the invention, FIG. 6 is a simplified diagrammatic longitudinal section of an ink cartridge according to the second embodiment of the invention, FIG. 7 is a block diagram of an embodiment of a conversion circuit according to the invention, included in the device in FIG. 1, FIG. 8 is a timing diagram of control signals applied to the ink ejection means included in the device in FIG. 1, FIG. 9 is a timing diagram of signals measured during the phase of checking the operation of the ink reservoir or the ink ejection means, FIG. 10 is a first embodiment of an ink detection algorithm according to the first embodiment of the invention, FIG. 11 is a second embodiment of an ink detection algorithm according to the first embodiment of the invention, FIG. 12 is a third embodiment of an ink detection algorithm according to the first embodiment of the invention, FIG. 13 is a simplified diagrammatic longitudinal section of a portion of an ink ejection means, situated in the printing head of FIG. 2, and used in the second embodiment of the invention, FIG. 14 is a simplified electrical diagram of the electrical part of the ink ejection means and ink cartridge according to the second embodiment of the invention, and FIG. 15 is an embodiment of an operation-checking algorithm according to the second embodiment of the invention.

Referring to FIG. 1, an image transfer device 10 according to the invention is included in an ink jet printer and receives data to be printed DI through a parallel input port 107 connected to an interface circuit 106. The circuit 106 is connected to an ink ejection control circuit 110, which controls an ink cartridge 111, via an amplification circuit 114.

The image transfer device 10 can be integrated into any image or data processing device depicted generically under the reference numeral 11. Thus the reference 11 can designate generically a printer, such as an ink jet printer or laser printer, or a facsimile machine. The components other than those of the image transfer device 10 are well known to experts and are consequently neither depicted nor described.

The ink cartridge 111 is replaceable and mounted on a carriage moving to and fro in translation and actuated by a motor 102. The ink cartridge 111 essentially includes an ink reservoir 112 and a plurality of ink transfer means. In the case of the ink jet printer, the plurality of ink transfer means is included in a printing head or ejection head 113 depicted in FIG. 2 and briefly described below.

The printer also has a main data processing circuit 100, associated with a read-only memory 103 and a random access memory 109. The read-only memory 103 contains the operating programs for the main processing circuit 100 while the random access memory 109, also associated with the ink ejection control circuit 110, temporarily stores the data DI received through the interface 106 and the data processed by the main processing circuit 100.

The main processing circuit 100 is connected to a display 104, on which the main processing circuit 100 controls the display of messages representing the operation of the printer. The main processing circuit 100 is connected to a keypad 105, including at least one switch, by means of which the user can transmit operating commands to the printer.

The main processing circuit 100 is also connected to the motor 102 via an amplification circuit 101. The motor 102 moves the carriage carrying the printing cartridge 111. The motor 102 is, for example, a stepping motor.

The main processing circuit 100 is, finally, connected to a control circuit 117 for controlling a purge pump 118. The purge pump 118 serves to purge the printing head 113.

As FIG. 2 shows, the printing head 113 includes a junction pipe 200 connected on the one hand by a filter to the ink reservoir 112 (FIG. 1) and on the other hand to ink ejection means 208. The ink ejection means 208 comprise a plurality of identical parallel ink transfer means, or ejection channels 204. The latter are arranged on a silicon plate 206 which is itself carried by an aluminium-based plate. The ejection channels 204 are, moreover, integrated into a glass structure 207 covering the silicon plate. The ejection channels 204 end in respective ink ejection orifices 203, defined in a front plate 209 situated opposite the sheet to be printed. All the orifices 203 are disposed side by side, regularly spaced along a straight-line segment.

Only six ejection channels 204 are depicted in FIG. 2. In practice, the printing head conventionally includes some several tens of ejection channels, for example sixty four.

Each ejection channel 204 encloses a trigger component, for example in the form of a resistance 205 forming an electro-thermal converter. According to a variant not shown, the trigger component is a piezoelectric component. Depending on the data to be printed for each position of the printing head with respect to the printing medium, such as a sheet of paper, resistances 205 are powered for a predetermined time. The energy dissipated in a powered resistance 205 vaporises a small quantity of ink situated in the corresponding ejection channel 204. This vaporisation leads to the formation of a bubble of ink vapour, and a drop of ink is ejected from the corresponding orifice under the effect of the pressure exerted by the bubble.

Referring to FIG. 3, the printing head 113 is assumed to have 64 ejection channels 204. It includes 64 identical heating resistances 205 forming electro-thermal converters integrated into the ejection channels 204, and 64 diodes 31. Each resistance 205 is in series with a diode 31 and this connection in series forms a branch of a matrix network with one of eight inputs CM1 to CM8 and one of eight outputs SG1 to SG8 which are the cathodes of the diodes 31. Each of these branches is associated with an ejection channel 204 and forms a circuit for triggering this channel. Hereinafter, an input CM1–CM8 is called a common connection point while an output SG1–SG8 is called a segment connection point.

Any common connection point CM1–CM8 is connected in parallel to each of the segment connection points SG1 to SG8 through a branch including a resistance 205 connected to the anode of an associated diode 31. The cathode of the diode 31 is connected to the segment connection point SG1 to SG8 in question. Any segment connection point SG1–SG8 is connected in parallel to each of the common connection points CM1 to CM8 by a previously described branch.

From an electrical point of view, the segment connection points SG1 to SG8 represent the individual ejection signals for each channel and are connected to the ink contained in the reservoir 112, via the ink in the printing head 113 and the junction pipe 200. The ejection signals for each channel pass an area, where structurally very little insulant with respect to the ink is present, and are therefore in contact by capacitive effect with the ink. The latter is therefore polarised according to the electrical potential of these points. According to other embodiments, the relationship between the segment connection points and the ink is of the resistive type.

With reference to FIG. 4, the amplification circuit 114 for supplying current pulses to the resistances 205 includes a preamplifier 41 with eight inputs and eight outputs. The inputs of the preamplifier 41 are connected to eight control outputs COM1 to COM8 of the ink ejection control circuit 110. Each of the control outputs COM1 to COM8 is able to supply a control signal, also given the reference COM1 to COM8 in order to simplify the notation.

The outputs of the preamplifier 41 are connected to eight respective inputs of a switching amplifier 43 connected to a current source 44. The eight outputs of the switching amplifier 43 are respectively connected to the common connection points CM1 to CM8 of the printing head 113.

A connection point CM1 to CM8 is fed with current by the source 44 according to the control signal COM1 to COM8.

A second switching amplifier 42 includes eight inputs and eight outputs. The inputs of the second switching amplifier 42 are connected to eight outputs SEG1 to SEG8 of the ink ejection control circuit 110. Each of the control outputs SEG1 to SEG8 is able to supply a control signal, also given the reference SEG1 to SEG8 in order to simplify the notation.

The outputs of the second switching amplifier 42 are respectively connected to the segment connection points SG1 to SG8. The second switching amplifier 42 includes a common earth connection and connects one of the segment connection points SG1 to SG8 to earth when a signal is applied to its corresponding input SEG1 to SEG8.

Thus, when a common connection point is supplied with current and a segment connection point is connected to earth, a current is established through the corresponding resistance 205 in response to the control signals generated by the ink ejection control circuit 110. The ejection channel 204 then ejects ink.

The amplification circuit 114 is carried by the printer.

With reference to FIG. 5, the image transfer device includes a carriage 60 for carrying the printing cartridge 111. The carriage is driven in a to-and-fro movement on a movement path formed by guide rails 67. The motor 102 drives the carriage 60 by means of a belt device 63. The movement path is parallel to a line on a printing medium, not shown, such as a sheet of paper.

The printing medium is guided and held by a guide and bearing roller 68.

To print a line on the printing medium, the ink cartridge is first of all positioned at an initial position opposite the start of the line to be printed, and then the ink cartridge 111 is moved on the movement path while the ejection control circuit 110 causes drops of ink to be ejected according to the data to be printed. When the line is printed, the ink cartridge is returned to its initial position.

As a variant, the image transfer device includes a movable printing head and a fixed reservoir connected by a flexible channel. This type of device is for example used to print on cloth.

According to another variant, the image transfer device includes a printing head associated with a reservoir of reduced volume, the printing head and the reservoir being mobile. The reservoir of the head is filled periodically by means of a second fixed reservoir, with a greater volume.

The printer described above is conventional and well known to experts. It will not, therefore, be detailed further.

According to the first embodiment of the invention, the fact that the ink receives energy during the normal printing process is exploited to determine whether there is ink present in the reservoir, or whether the latter is empty.

The inventors have observed that part of the energy applied to the resistance 205 is transmitted to the ink situated in the ejection channel 204, and then to all the ink contained in the reservoir 112 through the junction pipe 200. The energy transmitted to the ink produces electromagnetic radiation. The electromagnetic radiation is determined by the presence of ink in the ejection channel. When there is no longer any ink in the injection channel, no electromagnetic radiation is produced.

Thus, according to the first embodiment of the invention, the printer comprises in general terms a means for transmitting energy to ink contained in the ink transfer means, and a means for analysing the energy transmitted to the ink, with a view to checking the operation of the ink reservoir.

The printer comprises more particularly a means for detecting the energy transmitted to the ink. In the first embodiment of the invention, the means for detecting the energy is a means for sensing the electromagnetic radiation produced by the energy transmitted to the ink by the electrical ink ejection control signals. The printer also comprises a means of converting the electromagnetic radiation sensed into a signal representing the presence or absence of ink in the reservoir.

Thus, as can be seen in FIG. 1, a detector 116 is connected to a conversion circuit 115, itself connected to the main processing circuit 100. In the first embodiment of the invention, the detector 116 is an electromagnetic sensor 116*a*. The electromagnetic sensor 116*a* detects electromagnetic signals dependant on the presence or absence of ink in the printing head 113 and converts the electromagnetic signals received into an electrical signal. The electromagnetic sensor 116*a* supplies the electrical signal to the conversion circuit 115, which supplies in response the main processing circuit 100 with an item of binary data for the presence or absence of ink.

In the preferred embodiment, the electromagnetic sensor 116*a* is a long metal component such as a ribbon. The electromagnetic sensor 116*a* is for example made of aluminium or another conductive material. The electromagnetic sensor 116*a* is disposed on the movement path of the carriage 60 and preferably extends over the whole length of travel of the carriage 60 and consequently that of the ink cartridge 111. The electromagnetic sensor 116*a* is substantially parallel to the movement path of the ink cartridge 111. The electromagnetic sensor 116*a* is bonded to part of the structure of the printing device. The electromagnetic sensor detects electromagnetic radiation caused by the transmission of energy to the ink contained in the reservoir 112 during the printing of a document. By virtue of the long configuration of the electromagnetic sensor 116*a* and its arrangement on the length of the travel of the ink cartridge 111, detection is carried out whatever the position of the ink cartridge 111 on the movement path.

It is observed that the electromagnetic sensor 116*a* described here serves as an antenna.

As already stated, the transmission of energy, and therefore the electromagnetic radiation in the first embodiment of the invention, are conditioned by the presence of ink in the ejection channels 204. When ink is contained in the reservoir in a sufficient quantity to feed the ejection channels 204, energy is transmitted to the ink contained in the reservoir. Detectable electromagnetic radiation results therefrom. Conversely, when there is not sufficient ink in the reservoir to feed the ejection channels, the energy is not transmitted to the ink contained in the reservoir. There is no electromagnetic radiation.

To detect the absence or presence of ink in the reservoir, the electromagnetic sensor 116*a* detects the energy transmitted to the ink contained in the reservoir, by detecting the electromagnetic radiation caused by the transmission of energy.

It should be noted that if there are air bubbles in the ejection channels, leading to disruption of printing, these air bubbles are detected by the electromagnetic sensor 116*a* in a similar manner to an absence of ink in the reservoir.

The man skilled in tha art will be able to conceive variants. Notably, an electromagnetic sensor can be positioned on the carriage or on the ink reservoir. The sensor is thus brought closer the ink to be detected.

According to another variant, the electromagnetic sensor does not extend over the whole travel of the ink cartridge 111, but only over an area of this travel. In particular, an electromagnetic sensor can be positioned close to the purge pump 117 which serves to clean the ejection head. This electromagnetic sensor is more particularly designed for use with the third algorithm embodiment described with reference to FIG. 12.

In general, only one electromagnetic sensor equips the printer; however, it is possible to provide several sensors able to be used alternately.

According to the second embodiment of the invention, the printing head is modified to apply, at a predetermined point, an electrical signal to the ink contained in any one of the ink transfer means, in this case any one of the channels 204, and then it is detected whether there results therefrom a transmission of energy to the ink in the reservoir so as to check the operation of the transfer means in question, in this case the channel in question.

Thus, according to the second embodiment of the invention, the printer includes, in general terms, a means for transmitting energy to ink contained in the ink transfer means, a means for analysing the energy transmitted to the ink, with a view to checking the operation of the ink transfer means.

More particularly, the printer comprises a means for generating electrical signals, a means for transmitting energy from the electrical signals to ink contained in the ink transfer means, a means for detecting the energy transmitted to the ink, and a means for producing signals representing the operation of the ink transfer means according to the energy detected.

FIG. 6 depicts diagrammatically the ink reservoir 112 connected to the printing head 113 by the junction pipe 200, in the case of the second embodiment of the invention.

The reservoir 112 is formed by a casing made of plastic 119 in which a spongy body impregnated with ink is placed. The detector 116 is a conductive plate 116*b* which is positioned against an external face of the casing 119. The conductive plate 116*b* is made of metal, for example aluminium, or another conductive material. The casing 119 is insulating, at least in the area situated between the plate 116*b* and the ink. The plate 116*b* is covered with a plastic plate 120 to insulate it electrically and protect it against impacts.

The ink contained in the reservoir 112 and the plate 116*b* form a capacitor 121. The area of the casing 119 situated between the ink contained in the reservoir 112 and the plate 116*b* forms the dielectric of the capacitor 121.

The metal plate 116*b* is connected to the conversion circuit 115 (FIG. 1), itself connected to the main processing circuit 100. When the metal plate 116*b* receives an electrical signal coming from the reservoir 112, the plate 116*b* supplies the electrical signal to the conversion circuit 115 which, in response, supplies information on the normal or abnormal operation of the ink ejection means to the main processing circuit 100.

FIG. 7 depicts a preferred embodiment of the conversion circuit 115 which comprises a comparator 73 for comparing a signal supplied by the detector 116 with a reference signal TR, and supplying the logic signal EL according to the result of the comparison.

In the first embodiment of the invention, the conversion circuit 115 comprises an amplifier 71 connected to an envelope detector 72. The envelope detector 72 is connected to a first input to the comparator 73. An adjustable voltage generator 74 is connected to a second input of the comparator 73. An output from the comparator 73 is connected to the processing circuit 100.

In the second embodiment of the invention, the conversion circuit 115 is identical, except it does not comprise the envelope detector, the amplifier being directly connected to the comparator.

The detector 116 supplies an electrical signal S1 to the amplifier 71, which amplifies the electrical signal S1 in terms of current and voltage so as to facilitate the subsequent processing. The electrical signal S1 is a function of the normal or abnormal operation of the ink reservoir and the ink ejction means.

In the first embodiment, the electrical signal S1 is more particularly a function of the electromagnetic radiation detected, and therefore of the energy transmitted to the ink contained in the reservoir, and consequently of the presence or absence of ink in the reservoir.

In the second embodiment, the electrical signal S1 is more particularly a function of the normal or abnormal operation of the ink ejction means.

In the first embodiment, the amplifier 71 supplies the amplified signal SA to the envelope detector 72 which determines the amplitude of the amplified signal. The output signal S2 from the envelope detector 72 is supplied to the comparator 73 for comparison with the continuous adjustable reference voltage TR supplied by the generator 74. The value of the reference voltage TR is a decision threshold whose mode of selection will be disclosed hereinafter.

In the second embodiment, the amplifier 71 supplies the amplified signal SA to the comparator 73 for comparison with the continuous adjustable reference voltage TR.

Adjusting the reference voltage TR enables the total gain of the device 115 with its associated detector 116 to be adjusted simply by varying the decision threshold.

If the envelope detector 72 supplies a signal S2 above the decision threshold TR delivered by the generator 74, the comparator 73 delivers a logic high or 1 (TTL level) state EL to the processing circuit 100. In the contrary case, the comparator 73 delivers a logic low or 0 state EL to the processing circuit 100.

FIG. 8 depicts a timing diagram of control signals generated by the ink ejection control circuit 110. Signals COM1 to COM8 supplied respectively to the outputs COM1 to COM8 are at a high level for a period determined successively and cyclically so that the common connection points CM1 to CM8 are selected successively throughout the corresponding control pulse period. At a given moment, the group of eight branches 205, 31 corresponding to the selected common connection point CM1–CM8 is liable to have a current passing through it.

Simultaneously, the signals SEG1 to SEG8 are generated selectively according to the data to be reproduced. A signal SEG1 to SEG8 at a high level selects a respective segment connection point SG1 to SG8.

Each pulse (high level) appearing at an output SEG1 to SEG8 of the ink ejection control circuit 110 lasts around half the period of the pulse supplied to an output COM1 to COM8. The pulses SEG1, SEG3, SEG5 and SEG7 of odd rank are generated during the first half of the corresponding pulse COM1 to COM8 while the pulses SEG2, SEG4, SEG6 and SEG8 of even rank are generated during the second half of the corresponding pulse COM1 to COM8.

The signals COMn and SEGm control the operation of one of the ejection channels 204. An ejection channel 204, corresponding to a branch 205, 31 between a common connection point CMn, with n between 1 and 8, and a segment connection point SGm, with m between 1 and 8, has a current passing through it for a period of time during which the common connection point and segment connection point in question are selected simultaneously.

Thus, in the example in FIG. 8, the control signal COMn, applied to the common connection point CMn, is at a high level during a period of time $t_0$–$t_3$, and the control signal SEGm, applied to the segment connection point SGm, is at a high level during the period of time $t_1$–$t_2$, with $t_0$, $t_1$, $t_2$ and $t_3$ moments such that the relationship $t_0<t_1<t_2<t_3$ is verified.

Thus the branch 205, 31 between the common connection point CMn and the segment connection point SGm has a current passing through it for the period of time $t_1$–$t_2$.

According to the first embodiment of the invention, the signals COMn and SEGm are used to check the operation of the ink reservoir.

According to the second embodiment of the invention, the signals COMn and SEGm are used to check the operation of the ejection channel associated with them.

FIG. 9 depicts two examples of amplified signals SA1 and SA2 leaving the amplifier 71, corresponding respectively to two possible cases of operation, when the control signals COMn and SEGm in FIG. 8 are applied to the printing head 113.

As a variant, the electrical signals applied to the printing head 113 to check the operation of the ink reservoir and the ejection channels are specific and different from the printing control signals. For example, the pulses have shorter durations than the pulses for printing, so as not to eject ink, while being sufficiently long to transmit energy to the ink.

The electrical signals are preferably supplied by the control circuit 110. However, it is also possible to provide a specific circuit to supply the electrical signals used to check the ink reservoir and the ejection channels.

The first signal SA1 corresponds to normal operation of the ink reservoir and the printing head, that is to say ink is present in the reservoir and the ejection channel 204. The signals COMn and SEGm control the passage of an electrical signal through the resistance 205 and diode 31 associated with them. This electrical signal transmits energy to the ink contained in the channel 204 in question. The energy is then transmitted to the ink contained in the reservoir 112, and then to the circuit 115.

The threshold TR is selected so that the signal SA1 is above the threshold in the period of time $t_0$–$t_1$ and in the period of time $t_2$–$t_3$, corresponding to a high level of the control signal COMn and to a simultaneous low level of the control signal SEGm.

In the period of time $t_1$–$t_2$ corresponding to a high level of the control signals COMn and SEGm, the signal SA1 becomes negative, and therefore below the threshold TR.

The second signal SA2 corresponds to a case where there is no longer any ink in the channel 204 in question. The threshold TR is selected so that the signal SA2 is above the threshold TR for substantially the period $t_0$–$t_3$, and at least during the period $t_1$–$t_2$, which gives a second selection criterion for the threshold TR.

According to one example embodiment, the threshold TR equals 2 volts, and the signals SA1 and SA2 have a maximum value of 2.5 volts.

Referring to FIG. 10, a first embodiment of an algorithm according to the first embodiment of the invention is stored in the read-only memory 103 of the printing device. The algorithm comprises steps E10 to E16, which pass in parallel with the main data printing and control programs of the printing device assembly. The algorithm checks the operation of the ink reservoir.

Step E10 is an initialisation of the algorithm corresponding to the start of printing of a page of a document. Step E10 is followed by step E11, which consists of checking whether a line skip will be made by the carriage 60 moving the ink cartridge 111. This line skip is identified by the absence of data to be printed simultaneously with the fact that the carriage does not move the head horizontally. When the response is positive, the algorithm returns to step E11. This is because none of the signals COM1 to COM8 and SEG1 to SEG8 has been applied to the head in order to eject ink, and so no electromagnetic radiation caused by printing occurs.

When the response is negative, the algorithm moves to step E12. In this case, the carriage will move in translation opposite the printing medium. The signals COM and SEG are activated so as to eject ink to form the characters to be printed. Electromagnetic radiation is produced in the ink cartridge 111 which is then sensed by the sensor 116*a* and then processed by the conversion circuit 115, which supplies the processing circuit 100 with a logic high or low EL representing the presence or absence of ink in the ink cartridge 111. The logic state EL is the result of the detection of the energy transmitted to the ink contained in the reservoir 112. At step E12, the processing circuit 100 reads the value of the logic state EL and stores it in the random access memory 109.

The following step E13 checks whether the carriage 60 returns to its initial position at the edge of the page, which corresponds to the end of printing of a line. So long as the response is negative, that is to say the current line is not completely printed, the algorithm returns to step E12. The loop formed by steps E12 and E13 leads to the storage of a succession of logic states EL corresponding to the printing of a line. When the carriage returns to its initial position, the algorithm moves to step E14.

The algorithm checks at step E14 whether at least one logic high or 1 EL has been stored at step E12.

An affirmative response corresponds to the detection of radiation corresponding to normal operation, that is to say the presence of ink in the reservoir 112. The algorithm then returns to step E11 to test the printing of the following line.

A negative response at step E14 corresponds to the absence of ink in the reservoir 112. The algorithm moves to step E15 to display an error message on the display 104 for the user. The current printing is interrupted and the data still to be printed are stored.

The following step E16 consists of awaiting intervention by the operator. When he replaces the empty cartridge with a fresh ink cartridge, he activates a reset button on the keypad 105 which enables the device to resume a normal operating mode. The algorithm then returns to step E10.

As a variant, step E12 stores the logic state EL only if it is high. A working variable is initialised at 0 at the start of each printing line. The working variable is equal to 1 if at least one logic high is read at step E12 effected during the looping E12–E13 corresponding to a line. Step E14 tests the value of the working variable.

According to another variant, step E14 uses correlation measurements between the signals COM1 to COM8 and SEG1 to SEG8 and the logic state EL, so as to improve the quality of the decision. The reading of the logic state EL takes place only after the signals COM1 to COM8 and SEG1 to SEG8, taking account of the signal propagation times. This variant enables background noise to be eliminated.

According to a further variant, the tests are not effected line by line (steps E11 to E14), but according to a predetermined period of time.

FIG. 11 depicts a second embodiment of an algorithm according to the first embodiment of the invention. This algorithm is stored in the read-only memory 103 of the printing device depicted in FIG. 1. This algorithm checks the operation of the ink reservoir.

The algorithm comprises steps E20 to E27. This embodiment is more particularly designed to check for the presence of ink in an image transfer device of the ink jet type having several ink cartridges each comprising a reservoir and an ejection head. Such a device is, for example, a colour printer. The test for the presence or absence of ink is effected between the printing of two pages.

At step E20, the printing head is positioned opposite an area situated outside the printing medium, for example level with a purge pump serving to clean the ejection head of ink bubbles formed therein.

A selection variable n is initialised at 1. The variable n selects the various reservoirs and associated ejection heads. For example, in the case of N=4 reservoirs of inks of different colours, the correspondence between the variable n and the reservoirs is:

n=1: black reservoir selected, n=2: yellow reservoir selected, n=3: cyan reservoir selected and n=4: magenta reservoir selected.

At the following step E21, the ink ejection control circuit 110 generates the electrical pulses required to eject, for example, ten drops of ink of the colour corresponding to the reservoir N.

As a variant, the electrical pulses generated have a sufficient duration to transmit energy to the ink and produce electromagnetic radiation while being too short to allow the ejection of ink drops.

Then, step E22 is the reading of the logic state EL supplied by the comparator 73 to the processing circuit 100.

The algorithm checks at step E23 whether the logic state read equals 1. If the result is positive, this means that ink is present as normal in the reservoir N. The algorithm then moves to step E25. If the result is negative, this indicates an absence of ink in the reservoir N. The algorithm then moves to step E24, to activate an alarm, for example by displaying an error message on the display 104 for the user. The algorithm then moves to step E25.

Step E25 increments the variable n by one unit, to move to another reservoir. Step E26 checks whether n is equal to 5. If the response is negative, at step E26 the algorithm returns to step E21 to test another reservoir. If the response is positive, this means that the four reservoirs of the printer have been checked. The algorithm moves to step E27 to end the test.

Referring to FIG. 12, a third embodiment of an algorithm according to the first embodiment of the invention is stored in the read-only memory 103 of the printing device depicted in FIG. 1. The algorithm comprises steps E30 to E34. This algorithm is more particularly designed to check for the presence of ink in an image transfer device of the ink jet type whose ejection head is not integral with the ink reservoir.

This type of arrangement affords the advantage of needing to replace only the reservoir when it is empty and reusing the ejection head. However, it is then necessary to purge the air contained in the connection channel to the head before recommencing printing. To this end, ink is pumped by the pump 117, generally in an excessive quantity to ensure that the air is completely purged.

The third embodiment optimises the pumping phase by limiting the quantity of ink pumped during a change of ink reservoir. This embodiment preferably uses the electromagnetic sensor which is positionned close to the purge pump, as previously described.

Step E30 is the positioning of the ejection head level with the purge pump 117.

At step E31, the electrical pulses required to eject 50 ink drops are generated by the control circuit 110 while the purge pump is activated.

The logic state EL supplied by the comparator 73 to the processing circuit 100 is read at step E32.

Step E33 tests the value of the logic state read in the preceding step. If it is equal to 0, this means that the ink has not reached the level of the ejection head and it is necessary to carry out another purge step. The algorithm returns to step E31.

If the logic state read is equal to 1, there is then sufficient ink in the ejection head. The device is ready to print and the algorithm moves to the end step E34.

As a variant, the third embodiment can be easily adapted to a colour printer having several ink reservoirs of different colours and a single printing head and also having a purge device to clean the channels of the printing head between the use of two different colours of ink.

FIG. 13 depicts, in a simplified diagrammatic form, the configuration of an embodiment of an ink transfer means, in this case an ejection channel 204 in longitudinal cross section. This embodiment of ejection channel corresponds more particularly to the second embodiment of the invention. The resistance 205 associated with the channel 204 is positioned in the vicinity of the latter so as to heat the ink contained in the channel 204 when a current passes through the resistance 205. The resistance 205 is connected to the anode 31*a* of the diode 31, itself connected to a segment connection point SEG1 to SEG8, not shown in FIG. 13.

In the channel portion in question, a layer of electrical insulant 240 is interposed between the ejection channel 204 proper and the electrical part formed by the resistance 205, the diode 31 and the electrical connections. The layer of insulant 240 includes three areas of different thicknesses.

The first area Z1 is situated between the resistance 205 and the channel 204. This area has an "average" thickness El, that is to say sufficient to insulate the resistance and channel electrically, while being low enough to allow the heat to pass from the resistance to the channel when the resistance is powered.

In this specific embodiment, the second area Z2 is situated between the anode 31*a* of the diode 31 and the channel 204. This area has a low thickness E2, forming the dielectric of a capacitor 230 thus created between the anode 31*a* of the diode 31 and the ink contained in the channel 204. In other configurations, the second area can be situated between other designed elements capable of transferring the energy to the ink.

The third area Z3 is situated between the connections and the channel 204 and has a high thickness E3 to afford good electrical insulation.

Thus, when an electrical signal is applied to the branch including the resistance and diode in question, a part of the energy of this signal is transmitted to the ink contained in the channel 204, by capacitive effect through the area of insulant of low thickness.

The location of the area Z2 of insulant of low thickness E2, and its dimensions, are determined so as to transmit energy to only one selected channel.

Referring to FIG. 14, a common connection point CM1 to CM8 is connected to all the segment connection points SG1 to SG8 through a resistance 205 in series with a diode 31. The anode of each of the diodes 31 is connected to the ink contained in the channel 204 associated therewith. In the case of the second embodiment, the capacitive connection between the anode of the diode and the ink is represented by the capacitor 230.

If there is ink present in the channel 204 in question, it conducts between the capacitor 230 and the ink reservoir 112, that is to say as far as the capacitor 121 formed between the ink in the reservoir 112 and the plate 116*b*.

If there is no more ink in the channel 204 in question, electrical conduction no longer exists between the capacitor 230 and the reservoir 112.

The presence or absence of ink in the channel 204 is represented by a switch 220.

Referring to FIG. 15, a preferred embodiment of an algorithm according to the second embodiment of the invention is stored in the read-only memory 103 of the printing device. The algorithm includes the steps E80 to E98 for checking successively the operation of each of the channels 204.

The memory 109 includes registers for storing the current values of two working variables m and n, which are two integers between 1 and 8, and for storing two logic state values EL1 and EL2.

Step E80 is the positioning of the carriage, and therefore of the printing head, opposite an area situated outside the printing medium, for example close to the purge pump 118. The two variables m and n are initialised to 1. The variable n relates to the ranking of a control signal COMn, between 1 and 8, and the variable m relates to the ranking of a control signal SEGm, between 1 and 8. The maximum values of m and n are dependent on the number of ejection channels, equal to 64 in the example described.

Step E80 is followed by step E81, which consists of generating a pulse (high level) for the signal COMn. The signal COMn generated is a pulse as depicted in FIG. 8, between the times $t_0$ and $t_3$, corresponding respectively to the steps E81 and E86. The signal COMn, generated here for the purpose of checking the operation of the printing head, is identical to the signal generated to eject ink in order to print.

As a variant, the pulse generated between the steps E81 and E86 has a shorter duration than a pulse for printing, so as not to eject ink, while being sufficiently long to transmit energy to the ink.

The signal COMn gives rise to a transmission of energy to the ink. This energy is then detected via the conductive plate 116*b*, then processed by the conversion circuit 115 which supplies the processing circuit 100 with a high or low logic state EL representing the normal or abnormal operation of the printing head 113. The logic state EL is the result of the detection of the energy transmitted to the ink contained in the reservoir 112. At step E82, the processing circuit 100 reads the value of the logic state EL and stores it in the random access memory 109 under the variable EL1.

The following step E83 consists of generating a pulse (high level) for the signal SEGm. The signal SEGm generated is a pulse as depicted in FIG. 8, between the times $t_1$ and $t_2$, corresponding respectively to the steps E83 and E85. Like the signal COMn, the signal SEGm, generated here for the purpose of checking the operation of the printing head, is identical to the signal generated to eject ink in order to print.

As a variant, the pulse generated between the steps E83 and E85 has a shorter duration than a pulse for printing, so as not to eject ink, while being sufficiently long to transmit energy to the ink.

At step E84, the processing circuit 100 reads the value of the logic state EL and stores it in the random access memory 109 under the variable EL2.

The signal SEGm returns to the low level at step E85 and the signal COMn returns to the low level at step E86.

The algorithm then moves to step E87 to test whether the variable EL1 is equal to 1.

A negative response to step E87 corresponds to an absence of ink in the reservoir 112. The algorithm moves to step E88 to store this information and then to step E89 to generate an alarm, consisting for example of displaying an error message for the user on the display 104.

An affirmative response to step E87 is followed by step E90 which tests whether the variable EL2 is equal to 1. An affirmative response corresponds to an absence of ink in the channel 204 in question. This information is stored at step E91 and an alarm is generated at step E92. The alarm is for example the display of an error signal on the display 104.

A negative response to step E90 and to step E89 and E92 are followed by step E93, which tests whether the variable m is equal to 8.

When the response is negative, this means that there are still channels to be tested; the variable m is then incremented by 1 at step E94, and the algorithm returns to step E81 to run through the steps previously described for another channel.

When the response is positive at step E93, the algorithm moves to step E95 to test whether the variable n is equal to 8, that is to say whether all the channels 204 have been tested.

When the response is negative, this means that there are still channels to be tested, and the variable n is incremented by 1 and the variable m is reinitialised to 1 at step E96. The algorithm returns to step E81 to run through the steps previously described for another channel.

When the response is positive at step E95, all the channels have been tested and the algorithm moves to the end-of-test step E98.

Of course, the present invention is in no way limited to the embodiments described and depicted, but on the contrary encompasses any variant within reach of the man skilled in the art.

We claim:

1. A device for checking the operation of a unit comprising an ink reservoir connected to at least one ink transfer means, for an image transfer device, comprising:

means for transmitting energy to ink contained in the ink transfer means;

means for detecting the energy transmitted to the ink, said detecting means comprising a detector disposed opposite the ink reservoir; and means for analyzing energy detected by said detecting means in order to check the operation of said unit.

2. An image transfer device including a unit comprising an ink reservoir connected to at least one ink transfer means, comprising:

means for transmitting energy to ink contained in the ink transfer means;

means for detecting the energy transmitted to the ink, said detecting means comprising a detector disposed opposite the ink reservoir; and means for analyzing energy detected by said detecting means in order to check the operation of said unit.

3. A device for checking the operation of a unit comprising an ink reservoir connected to at least one ink transfer means for an image transfer device, comprising:

means for generating electrical signals;

means for transmitting energy from the electrical signals to ink contained in the ink transfer means;

means for detecting the energy transmitted to the ink, said detecting means comprising a detector disposed opposite the ink reservoir; and means for producing signals representing the operation of said unit according to the energy detected by said detecting means.

4. An image transfer device including a unit comprising an ink reservoir connected to at least one ink transfer means, comprising:

means for generating electrical signals;

means for transmitting energy from the electrical signals to ink contained in the ink transfer means;

means for detecting the energy transmitted to the ink, said detecting means comprising a detector disposed opposite the ink reservoir; and means for producing signals representing the operation of said unit according to the energy detected by said detecting means.

5. A device according to claim 3 or 4, wherein said means for generating comprises means for generating control signals for the ink transfer means.

6. A device according to any one of claims 1 to 4, wherein the operation of said unit to be checked is a detection of a presence or absence of ink in the reservoir.

7. A device according to claim 5, further comprising:

means for converting the energy detected by said detecting means into a signal representing a presence or absence of ink in the reservoir.

8. A device according to claim 5, wherein said detecting means senses electromagnetic radiation caused by the energy transmitted to the ink by said control signals, and said device further comprises means for converting the electromagnetic radiation sensed into a signal representing a presence or absence of ink in the reservoir.

9. A device according to claim 8, wherein said means for sensing electromagnetic radiation comprises a metal component forming an antenna.

10. A device according to claim 8, wherein said means for sensing electromagnetic radiation comprises a metal ribbon.

11. A device according to claim 8, wherein at least the ink transfer means is able to move in a movement path, and said means for sensing electromagnetic radiation is disposed in the movement path.

12. A device according to claim 8, wherein said means for sensing electromagnetic radiation is disposed on the ink reservoir.

13. A device according to claim 8, wherein said means for converting the sensed electromagnetic radiation comprises a comparator for comparing a signal supplied by said sensing means with a reference signal and supplying the signal representing the absence or presence of ink, according to the result of the comparison.

14. A device according to any one of claims 1 to 4, wherein the operation of said unit to be checked is the operation of said at least one ink transfer means.

15. A device according to claim 3 or 4, wherein said means for transmitting includes a first capacitor positioned between said means for generating and the ink transfer means.

16. A device according to claim 15, wherein said first capacitor is positioned between a means of triggering the transfer of ink and the ink transfer means.

17. A device according to claim 15, wherein said first capacitor has a pole formed by the ink contained in the ink transfer means.

18. A device according to claim 17, further comprising an insulant between said trigger means and the ink transfer means, wherein said insulant comprises an area of predetermined thickness adapted to form a dielectric of said first capacitor between a pole situated in said trigger means and said pole formed by the ink contained in the ink transfer means.

19. A device according to claim 14, for a plurality of ink transfer means, further comprising plural means for transmitting energy respectively for each of the plurality of transfer means, wherein each means for transmitting energy for one of the transfer means transmits energy only to said one of the transfer means.

20. A device according to claim 15, wherein said means for detecting further includes a second capacitor.

21. A device according to claim 20, wherein said second capacitor includes a first pole formed by a conductive plate and a second pole formed by the ink.

22. A device according to claim 21, wherein said conductive plate is positioned on said reservoir containing ink and connected to the ink transfer means.

23. A device according to claim 22, wherein the reservoir is formed at least partially from an insulating material.

24. A device according to claim 3, wherein said producing means comprises a comparator for comparing the detected energy with a reference signal and supplying a signal representing the operation of the ink transfer means, according to the result of the comparison.

25. A method of checking the operation of a unit comprising an ink reservoir connected to at least one ink transfer means of an image transfer device, said method comprising the steps of:

transmitting energy to ink contained in the ink transfer means;

detecting the energy transmitted to the ink with a detector disposed opposite the ink reservoir; and analyzing the energy detected in said detecting step in order to check the operation of the unit.

26. A method of checking the operation of a unit comprising an ink reservoir connected to at least one ink transfer means of an image transfer device, said method comprising the steps of:

generating electrical signals, to transmit energy from the electrical signals to ink contained in the ink transfer means;

detecting the energy transmitted to the ink with a detector disposed opposite the ink reservoir; and producing signals representing the operation of the ink transfer means according to the energy detected in said detecting step.

27. A method according to claim 25 or 26, wherein the operation of the unit to be checked is a detection of a presence or absence of ink in the reservoir.

28. A method according to claim 26, wherein the step of detecting the energy transmitted to the ink by the electrical signals is effected simultaneously with transfer of the ink.

29. A method of transferring an image, comprising the steps of:

transferring ink from a reservoir to a printing medium by control means using electrical signals; and detecting energy transmitted to the ink by the electrical signals simultaneously with said ink transferring step with a detector disposed opposite the reservoir.

30. A method according to claim 26 or 29, wherein said step of detecting the energy transmitted to the ink comprises sensing electromagnetic radiation emitted by the ink when the energy is transmitted to the ink by the electrical signals.

31. A method according to any one of claims 25, 26 and 29, further comprising, for a line to be printed, the steps of:

detecting the energy transmitted to the ink by the electrical signals simultaneously with the printing of the line;

interrupting printing if the energy detected is below a threshold; and continuing printing if the energy detected is not below the threshold.

32. A method according to any one of claims 25, 26 and 29, for an use with image transfer device of the ink jet type comprising several ink reservoirs, further comprising the steps of:

positioning the transfer means opposite an area situated outside the printing medium;

controlling the ejection by the transfer means of a predetermined number of ink drops;

detecting the energy transmitted to the ink by the electrical signals simultaneously with the ejection of the ink;

repeating said controlling and detecting steps for each of the ink reservoirs; and activating an alarm if the energy detected is below a threshold.

33. A method according to claim 32, wherein said positioning, controlling, detecting, repeating and activating steps are effected between the printing of two pages of a document.

34. A method according to any one of claims 25, 26 and 29, further comprising the steps of:

positioning the transfer means opposite an area situated outside the printing medium;

controlling the ejection by the transfer means of a predetermined number of ink drops;

detecting the energy transmitted to the ink by the electrical signals simultaneously with the ejection of the ink; and repeating the controlling and detecting steps so long as the energy detected is below a threshold.

35. A method according to claim 32, wherein the area situated outside the printing medium is situated level with a pump for purging the transfer means.

36. A method according to claim 25 or 26, wherein the operation of the unit to be checked is the operation of the at least one transfer means.

37. A method of checking the operation of a plurality of ink transfer means of an image transfer device, said method comprising the steps of:

generating electrical signals, to transmit energy from the electrical signals to ink contained in one of the plurality of ink transfer means;

detecting the energy transmitted to the ink with a detector disposed opposite an ink reservoir; and producing signals representing the operation of the one of the plurality of ink transfer means according to the detected energy.

38. A method according to claim 37, wherein said steps of generating, detecting and producing are effected for each of the ink transfer means.

39. A method according to claim 37, wherein said step of detecting includes the step of deriving a first signal representing the detected energy.

40. A method according to claim 39, wherein said step of producing includes the step of converting the first signal to a second signal representing the operation of the ink transfer means.

41. A method according to claim 39, wherein said step of producing includes a comparison of the first signal with a predetermined threshold.

42. A method according to claim 37, further comprising the step of first positioning the transfer means opposite an area situated outside a printing medium.

43. A method according to claim 42, wherein the area situated outside the printing medium is situated level with a purge pump for the transfer means.

44. An ink jet device comprising an ink reservoir connected to at least one ink transfer means, said transfer means discharging ink to form an image, comprising:

means for transmitting energy to ink contained in the ink transfer means;

means for detecting the energy transmitted to the ink, said detecting means comprising a detector disposed opposite the ink reservoir; and means for analyzing energy detected by said detecting means in order to check the operation of said unit.

45. An ink jet device according to claim 44, wherein said ink transfer means generates energy to discharge ink.

46. A printing head for an image transfer device, said printing head comprising:

a plurality of ink transfer channels;

generating means for generating energy used for discharging ink from said plurality of ink transfer channels; and for each channel of said plurality of ink transfer channels, transmission means for transmitting energy to ink contained in the said channel, wherein the energy transmitted by said transmission means is used for detecting ink.

47. A printing head according to claim 46, wherein each of said transmission means comprises a capacitor.

48. A printing head according to claim 47, further comprising, for each of said transmission means, an insulant between a trigger means and said ink transfer channels, wherein said insulant comprises an area of predetermined thickness adapted to form a dielectric of said capacitor between a pole formed by an anode of a diode included in said trigger means, and a pole formed by the ink contained in said ink transfer channels.

49. A printing head according to claim 46, wherein said printing head is incorporated in a printer.

50. A printing head according to claim 46, wherein said printing head is incorporated in a facsimile machine.

51. A printing apparatus comprising:

an ink reservoir containing ink;

a conductive plate positioned on a portion insulated from the ink contained in said reservoir;

a printing head connected to said reservoir by a junction pipe, said printing head comprising an ink transfer channel; and detection means, using said conductive plate, for detecting energy transmitted to the ink contained in said channel to check operation of said channel.

52. A printing apparatus according to claim 51, wherein said printing apparatus is incorporated in a facsimile machine.

* * * * *

UNITED STATES PATENT AND TRADEMARK OFFICE

CERTIFICATE OF CORRECTION

PATENT NO. : 6,022,090

DATED : February 8, 2000

INVENTOR(S) : COUDRAY ET AL.

It is certified that error appears in the above-identified patent and that said Letters Patent is hereby corrected as shown below:

On the title page, Item
[56] References Cited:
U.S. PATENT DOCUMENTS, "Elhatem" should read --ElHatem et al.--.

COLUMN 2:
Line 59, "that" should read --that it--.

COLUMN 6:
Line 21, "ments" should read --ment--.

COLUMN 10:
Line 36, "tha" should read --the--.

COLUMN 15:
Line 37, "positionned" should read --positioned--.

COLUMN 18:
Line 15, "detector disposed oppo-" should read --detector; and--.
Line 16, "site the ink reservoir; and" should be deleted.

UNITED STATES PATENT AND TRADEMARK OFFICE

CERTIFICATE OF CORRECTION

PATENT NO. : 6,022,090

DATED : February 8, 2000

INVENTOR(S) : COUDRAY ET AL.

It is certified that error appears in the above-identified patent and that said Letters Patent is hereby corrected as shown below:

COLUMN 20:
Line 46, "an use with" should read --use with an--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*